US007504587B2

(12) United States Patent
Masu et al.

(10) Patent No.: US 7,504,587 B2
(45) Date of Patent: Mar. 17, 2009

(54) PARALLEL WIRING AND INTEGRATED CIRCUIT

(75) Inventors: Kazuya Masu, Kawasaki (JP); Kenichi Okada, Fujisawa (JP); Hiroyuki Ito, Yokohama (JP)

(73) Assignee: Semiconductor Technology Academic Research Center, Yokohama-shi (JP)

( * ) Notice: Subject to any disclaimer, the term of this patent is extended or adjusted under 35 U.S.C. 154(b) by 253 days.

(21) Appl. No.: 10/927,261

(22) Filed: Aug. 26, 2004

(65) Prior Publication Data

US 2005/0056455 A1 Mar. 17, 2005

(30) Foreign Application Priority Data

Aug. 29, 2003 (JP) ..... 2003-307086

(51) Int. Cl.
*H01B 7/00* (2006.01)

(52) U.S. Cl. ..... 174/117 R; 174/117 F; 174/117 FF

(58) Field of Classification Search ..... 174/261, 174/250, 117 FF; 361/764
See application file for complete search history.

(56) References Cited

U.S. PATENT DOCUMENTS 5,430,247 A * 7/1995 Bockelman ..... 173/33
5,877,667 A * 3/1999 Wollesen ..... 336/200
6,386,901 B1 * 5/2002 Caldwell ..... 439/425
2005/0208838 A1 * 9/2005 Horowitz et al. ..... 439/676

FOREIGN PATENT DOCUMENTS

JP 2003-258510 A 9/2003

OTHER PUBLICATIONS

Hidaka, H., et al., "Twisted Bit-Line Architectures for Mulit-Megabit DRAM's," *IEEE Journal of Solid-State Circuits*, 24(1):21-27, Feb. 1989.
Hoenigschmid, H., et al., "A 7F$^2$ Cell and Bitline Architecture Featuring Tilted Array Devices and Penalty-Free Vertical BL Twists for 4-Gb DRAM's," *IEEE Journal of Solid-State Circuits*, 35(5):713-718, May 2000.
Min, D.-S. and D.W. Langer, "Multiple Twisted Dataline Techniques for Mulitgigabit DRAM's," *IEEE Journal of Solid-State Circuits*, 34(6):856-865, Jun. 1999.
Ito, H., et al., "Low Crosstalk Differential Transmission Line Interconnect on Si ULSI," *Proceedings of Advanced Metallization Conference Asian Session*, Tokyo, Japan, Sep. 29-30, 2003, 2 pages.
Ito, H., et al., "Low Crosstalk Differential Transmission Line Interconnect on Si ULSI," *Proceedings of Advanced Metallization Conference*, San Diego, Calif., Oct. 19-21, 2004, 6 pages.

* cited by examiner

*Primary Examiner*—William H Mayo, III
(74) *Attorney, Agent, or Firm*—Christensen O'Connor Johnson Kindness PLLC

(57) ABSTRACT

A parallel wiring according to the present invention includes a plurality of differential lines juxtaposed in a reference direction, wherein each differential line includes two wiring lines which are substantially parallel to each other, and the two wiring lines oppose each other obliquely with respect to the reference direction.

12 Claims, 20 Drawing Sheets

PARALLEL WIRING AND INTEGRATED CIRCUIT

CROSS-REFERENCE TO RELATED APPLICATIONS

This application is based upon and claims the benefit of priority from prior Japanese Patent Application No. 2003-307086, filed Aug. 29, 2003, the entire contents of which are incorporated herein by reference.

BACKGROUND OF THE INVENTION

1. Field of the Invention

The present invention relates to a parallel wiring and integrated circuit which use differential lines.

2. Description of the Related Art

LSIs which implement powerful multi-function devices by microfabrication and integration based on the scaling law as a leading principle are supporting signal processing of hardware in the current IT network-oriented society. A powerful processor has a clock frequency more than 1 GHz and a chip size on cm order. In one chip, a hundred million MOS transistors are integrated. The performance of an integrated circuit is determined not only by the characteristics of individual MOS transistors. The circuit performance is determined rather by the wiring technique for connecting individual transistors.

In a conventional LSI wiring design, a metal wiring line is expressed by an RC lumped constant circuit including resistors and capacitors. In recent years, however, the inductance components of wiring lines cannot be neglected as the LSI frequency becomes high. For this reason, it is becoming difficult in principle to design a long-distance wiring line as an RC lumped constant circuit.

Indeed, long-distance wiring lines determine the performance of a whole circuit. To reduce the wiring delay, introduction of a low-resistance metal Cu and a low-k interlayer dielectric film has been examined increasingly. In this idea, a long-distance wiring line is divided, and repeaters are inserted such that the wiring line can be handled as an RC lumped constant circuit. However, when the number of repeaters increases, the circuit area and power consumption also increase.

When the signal frequency is on GHz order, and the line length is on cm order, the inductance component of a wiring line cannot be neglected, and it cannot be handled as an RC lumped constant circuit. It is essential to regard signal transmission as electro-magnetic transmission and design a wiring line as a transmission line.

Generally, transmission lines can be classified into two types: an unbalanced transmission line including a signal line and ground, and a differential transmission line including two signal lines (there are also structures including ground). A differential transmission line has excellent crosstalk robustness because common mode noise can be canceled, unlike an unbalanced transmission line. Differential transmission line structures can be classified as follows on the basis of the difference in wiring structure.

(i) Stacked-Pair Line, (ii) Co-Planar Line, (iii) Microstrip Line, and (iv) Strip Line Since a parallel wiring in an LSI includes a number of long-distance wiring lines in close vicinity, problems of wiring delay and crosstalk are posed. When a differential transmission line is used as a parallel wiring in an LSI, the problems of wiring delay and crosstalk can be solved. Presently, a parallel wiring on a board is implemented by arraying differential transmission lines in the horizontal direction. However, when a parallel wiring is to be designed in an LSI, many points must be taken into consideration in terms of wiring design, as compared to a board. For this reason, a parallel wiring design method unique to an LSI is necessary. For example, since the wiring size in an LSI is small, the ohmic loss component of wiring lines cannot be neglected. In addition, since the degree of freedom in wiring design is low, the limitation on the structure itself is large. If the inter-wire distance is shortened to increase the degree of integration, differential mode noise causes crosstalk between differential wiring lines in the parallel wiring. In a parallel wiring using differential transmission lines (i) to (iv), crosstalk by differential mode noise and the distance between differential wiring lines have a tradeoff relationship.

When a parallel wiring using differential transmission lines having the above-described wiring structure is designed in an LSI, the following problems are posed.

a) Crosstalk and the wiring area have a tradeoff relationship: (i) to (iv)
b) The characteristic impedance and the wiring resistance have a tradeoff relationship: (i), (iii), (iv)
c) When a pair of wiring lines are bent in the horizontal direction so as to prevent contact between them, they have different wiring lengths. Accordingly, mode conversion occurs (the differential component changes to an in-phase component): (ii) to (iv)
d) Since one layer is necessary as a ground plane, the wiring area and cost increase: (iii) and (iv)

As described above, when a parallel wiring is to be formed by using the conventional differential transmission lines, the problems of crosstalk, wiring area, characteristic impedance, loss, bending, and cost cannot be solved.

BRIEF SUMMARY OF THE INVENTION

It is an object of the present invention to provide a parallel wiring and integrated circuit which have excellent crosstalk robustness.

According to an aspect of the invention, there is provided a parallel wiring including a plurality of differential lines juxtaposed in a reference direction, wherein each differential line includes two wiring lines which are substantially parallel to each other, and the two wiring lines oppose each other obliquely with respect to the reference direction.

According to another aspect of the invention, there is provided a parallel wiring comprising: at least one first differential line including two wiring lines which are substantially parallel to each other and are juxtaposed in a reference direction; and at least one second differential line including two wiring lines which are substantially parallel to each other and are juxtaposed in the reference direction, wherein one wiring line of the first differential line and one wiring line of the second differential line adjacent to the one wiring line oppose each other obliquely with respect to the reference direction.

According to another aspect of the invention, there is provided a integrated circuit comprising the parallel wiring.

According to another aspect of the invention, there is provided a integrated circuit comprising the parallel wiring.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

The embodiments will be described below with reference to the accompanying drawing.

To broadband-transmit data in a parallel wiring in an LSI (Large Scale Integrated circuit), establishment of a parallel wiring technique for transmitting a high-speed signal is necessary. When a transmission line is used in a parallel wiring, high-speed signal transmission can be executed. When ground is formed in the LSI, the resistance value is very large, and it is difficult to form ideal ground. In this embodiment, a differential transmission line structure which does not always need ground will be examined.

In designing a parallel wiring using a differential transmission line, problems of crosstalk and wiring area (wiring occupation ratio) are posed, as described above. Crosstalk occurs due to coupling of inductivity or capacitance between wiring lines. The coupling strength is almost inversely proportional to the distance between the wiring lines. The signal phase difference between two wiring lines which form a differential transmission line is 180°, crosstalk is zero at a point equidistant from the two wiring lines.

When an aggressor wiring line is equidistant from the wiring lines of the differential transmission line, crosstalk components from the aggressor wiring line to the wiring lines of the differential transmission line are in phase. In this case, in-phase noise on the differential transmission line can be removed by a differential circuit.

In this embodiment, a parallel wiring having good anti-crosstalk performance and a small wiring area is implemented by arranging a pair of wiring lines in oblique directions (in diagonal directions) or arranging the differential transmission lines in a staggered pattern on the longitudinal section of the wiring structure of differential transmission lines.

Figure 1:
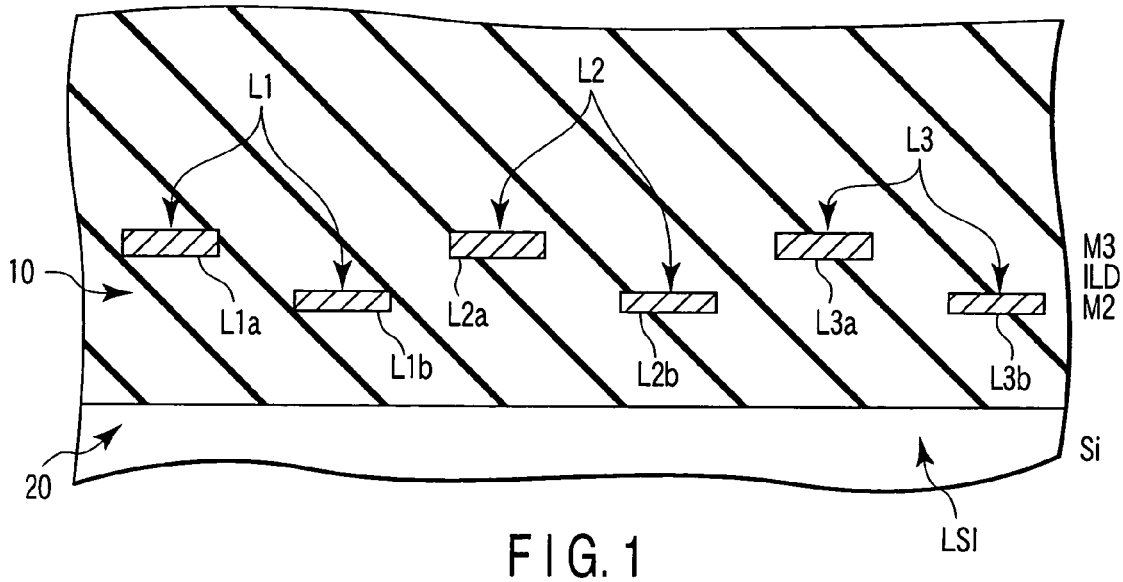
FIG. 1 is a longitudinal sectional view showing the wiring structure of a parallel wiring using differential transmission lines according to the first embodiment.

FIG. 1 is a longitudinal sectional view showing the wiring structure of a parallel wiring using differential transmission lines according to the first embodiment. FIG. 1 shows diagonal-pair lines.

Differential transmission lines L1, L2, and L3 shown in FIG. 1 are arranged in the horizontal direction above an Si (silicon) substrate 20 in an LSI. The differential transmission lines L1, L2, and L3 include pairs of substantially parallel signal wiring lines L1*a* and L1*b*, L2*a* and L2*b*, and L3*a* and L3*b*, respectively. The signal wiring lines of each differential transmission line have a diagonal structure in which they oppose each other obliquely with respect to the horizontal direction (reference direction). An ILD (interlayer dielectric film) 10 is formed between the wiring lines of each differential transmission line.

The signal wiring lines L1*a*, L1*b*, L2*a*, L2*b*, L3*a*, and L3*b* are made of a metal such as aluminum. The ILD 10 is made of $SiO_2$ or the like. The layer including the signal wiring lines L1*a*, L2*a*, and L3*a* arranged in the horizontal direction will be referred to as an M3 layer. The ILD 10 will be referred to as an ILD layer. The layer including the signal wiring lines L1*b*, L2*b*, and L3*b* arranged in the horizontal direction will be referred to as an M2 layer.

Figure 2A:
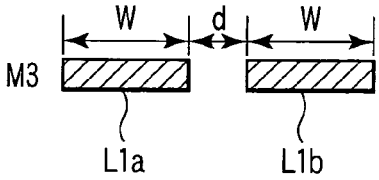
FIGS. 2A and 2B are longitudinal sectional views for comparing the differential transmission lines of the prior art and the first embodiment.
Figure 2B:
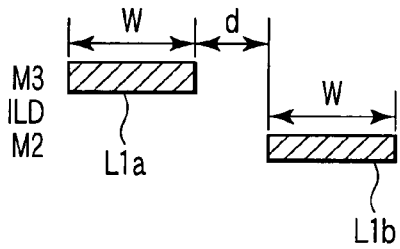

FIGS. 2A and 2B are longitudinal sectional views for comparing the differential transmission lines of the prior art and the first embodiment. FIG. 2A shows conventional co-planar lines. FIG. 2B shows a differential transmission line using a diagonal-pair line according to the first embodiment. Referring to FIGS. 2A and 2B, the thickness of each signal wiring line of the M3 layer is about 0.9 μm, the thickness of the ILD layer is about 1 μm, and the thickness of each signal wiring line of the M2 layer is about 0.6 μm.

In the co-planar lines shown in FIG. 2A, when the signal wiring line is lossless, and a differential impedance $Z_{diff}$ is 100 Ω, a relationship as shown in Table 1 is obtained between a wiring width W and an inter-wire distance d. The wiring width W is 1 μm to 20 μm. $Z_{diff}$ can be adjusted by changing the inter-wire distance d while keeping the wiring width W constant.

TABLE 1

| W [μm] | 1 | 4 | 8 | 12 | 16 | 20 |
|---|---|---|---|---|---|---|
| d [μm] | 2.2 | 4.2 | 6.8 | 9.8 | 13.3 | 16.5 |

In the diagonal-pair line shown in FIG. 2B, when the signal wiring line is lossless, and the differential impedance $Z_{diff}$ is 100 Ω, a relationship as shown in Table 2 is obtained between the wiring width W and the inter-wire distance d. Even in this case, the $Z_{diff}$ can be adjusted by changing the inter-wire distance d while keeping the wiring width W constant.

TABLE 2

| W [μm] | 1 | 4 | 8 | 12 | 16 | 20 |
|---|---|---|---|---|---|---|
| d [μm] | 1.3 | 3.9 | 7.2 | 10.5 | 14.5 | 18.0 |

Figure 3:
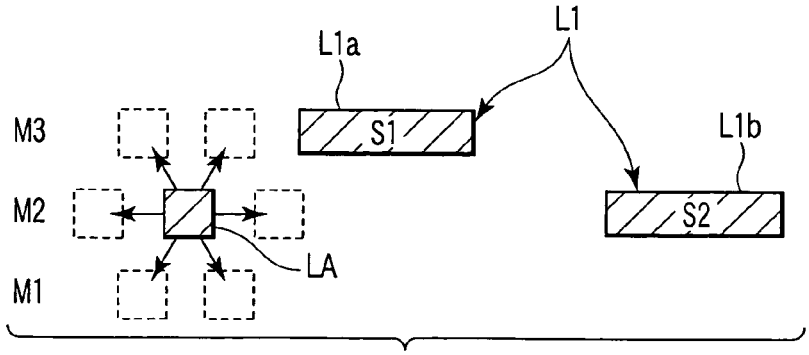
FIG. 3 is a longitudinal sectional view showing a coupling coefficient calculation method according to the first embodiment.

FIG. 3 is a longitudinal sectional view showing a coupling coefficient calculation method. The differential transmission line can cancel common mode noise. However, when the coupling strength between the aggressor wiring line and each signal wiring line changes, noise from the aggressor wiring line affects the signal wiring lines of the differential transmission line. As shown in FIG. 3, the coupling coefficient between an aggressor wiring line LA and the differential transmission line L1 is calculated by placing the aggressor wiring line LA at an arbitrary position. A coupling coefficient K is given by $$K=M/\sqrt{L_{line}L_{aggressor}} \quad (1)$$

where M is the mutual-inductance, and $L_{line}$ and $L_{aggressor}$ are the self-inductances of the differential transmission line and aggressor wiring line, respectively. To derive the coupling coefficient, a two-dimensional electromagnetic field simulator (2D extractor available from Ansoft) is used.

Figure 4A:
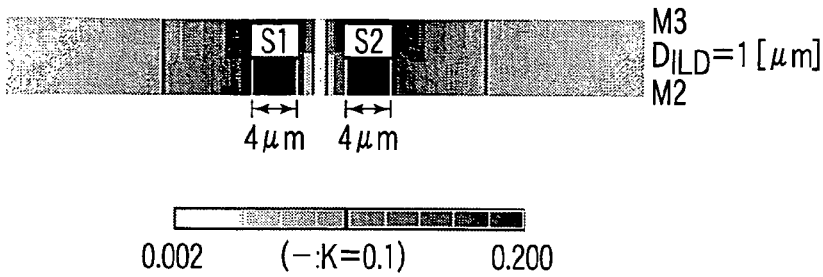
FIGS. 4A to 4C are views showing the distributions of coupling coefficients between an aggressor wiring line and the differential transmission lines according to the prior art and the first embodiment.
Figure 4B:
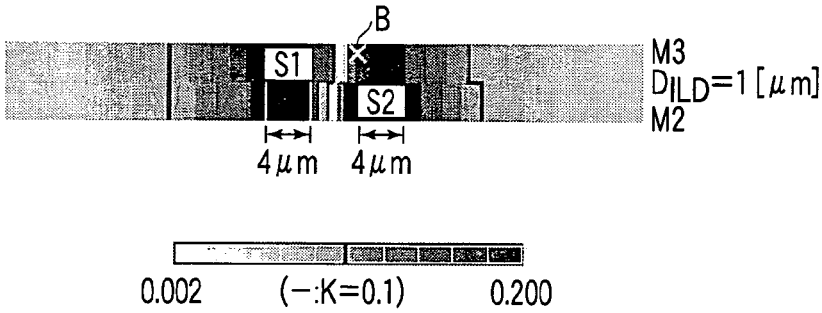
Figure 4C:
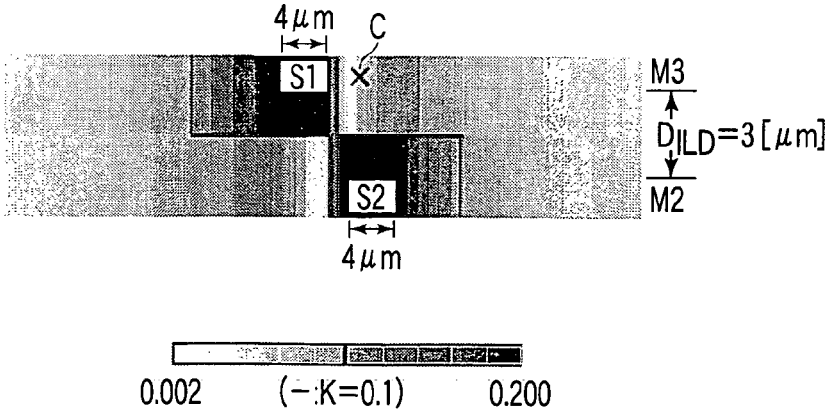

FIGS. 4A, 4B, and 4C are views showing the distributions of coupling coefficients between the aggressor wiring line and the differential transmission lines according to the prior art and the first embodiment, which are calculated by using the calculation method shown in FIG. 3. FIG. 4A shows the distribution in the conventional co-planar lines. FIG. 4B shows the distribution in the first diagonal-pair line according to the first embodiment. FIG. 4C shows the distribution in the second diagonal-pair line according to the first embodiment.

These differential transmission lines are designed such that the signal wiring lines are lossless, and the differential impedance $Z_{diff}$ is 100 Ω. The differential transmission lines have an excellent long-distance wiring characteristic. The wiring width W of each signal wiring line (S1 or S2) is 4 μm. Referring to FIGS. 4A, 4B, and 4C, the coupling strength is represented by gradation. The longer the distance between the differential transmission line and the aggressor wiring line becomes, the smaller the coupling coefficient becomes.

Referring to FIGS. 4B and 4C, thicknesses $D_{ILD}$ of the ILDs (interlayer dielectric films) are 1 μm and 3 μm. When an interlayer dielectric film that can be implemented by the Si-CMOS process is taken into consideration, an ILD whose thickness is almost equal to the wiring film thickness to several times larger (0.01 to 50 μm and, for example, 3 μm) than it can be implemented. In the thick ILD shown in FIG. 4C, the coupling coefficient in the vertical direction becomes smaller than that in the thin ILD shown in FIG. 4B. The coupling coefficient at a point B in FIG. 4B and that at a point C in FIG. 4C are about 0.2 and about 0.05, respectively.

Figure 5A:
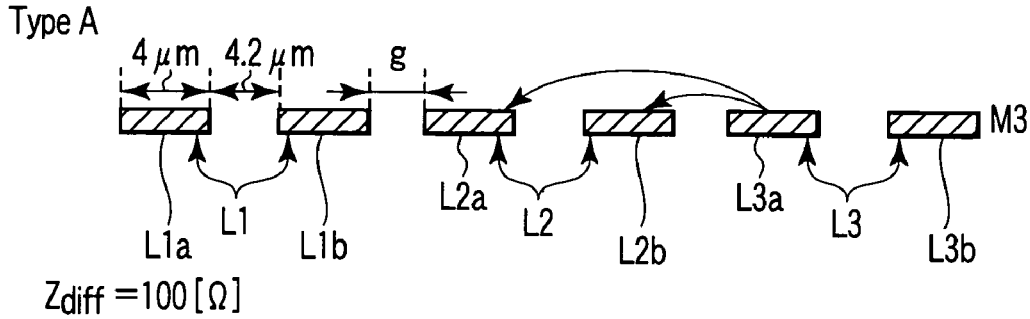
FIGS. 5A to 5C are longitudinal sectional views showing parallel wiring structures using the differential transmission lines according to the prior art and the first embodiment.
Figure 5B:
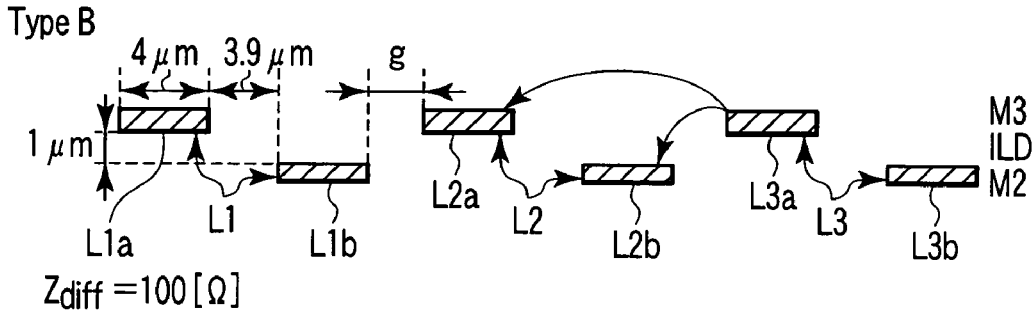
Figure 5C:
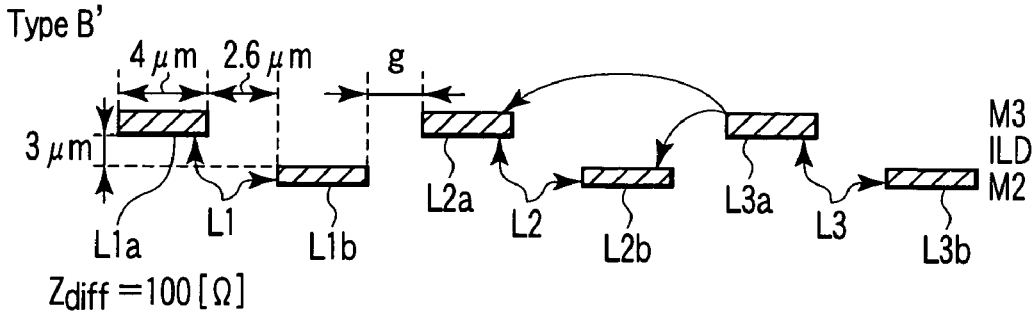

FIGS. 5A, 5B, and 5C are longitudinal sectional views showing parallel wiring structures using the differential transmission lines according to the prior art and the first embodiment. FIG. 5A shows the conventional co-planar lines (Type A). FIG. 5B shows the first diagonal-pair line (Type B) according to the first embodiment. FIG. 5C shows the second diagonal-pair line (Type B') according to the first embodiment through a thick ILD. The differential transmission lines L1, L2, and L3 shown in FIGS. 5A, 5B, and 5C have an interval of g μm in the horizontal direction. The pairs of signal wiring lines L1*a* and L1*b*, L2*a* and L2*b*, and L3*a* and L3*b* transmit differential signals.

Figure 6:
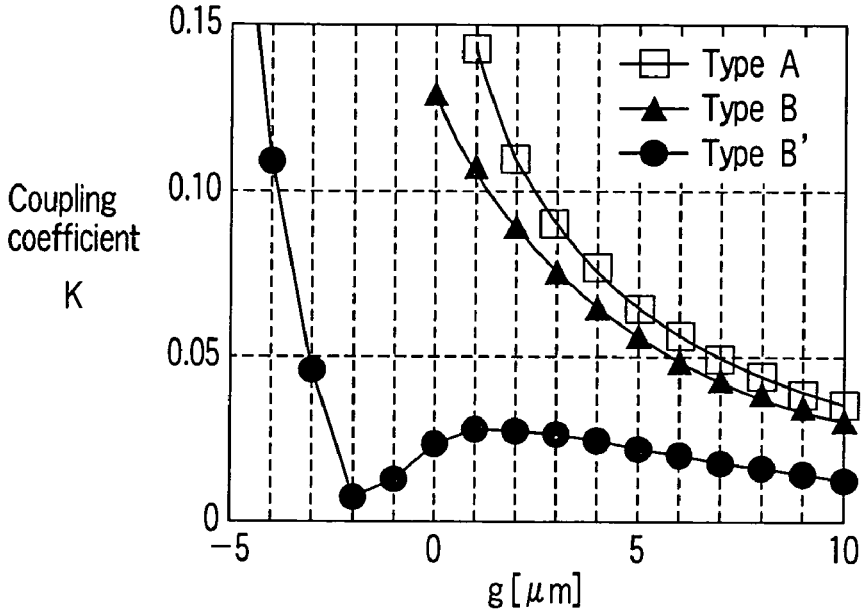
FIG. 6 is a graph showing the relationship between the coupling coefficient and the distance between the differential transmission lines in each of the parallel wiring structures according to the prior art and the first embodiment.

FIG. 6 is a graph showing the relationship between the coupling coefficient and the distance between the differential transmission lines in each of the parallel wiring structures shown in FIGS. 5A, 5B, and 5C. FIG. 6 shows the coupling coefficient K as a function of the distance g between the differential transmission lines. When the noise margin of the circuit is 5%, coupling coefficient K<0.1 is required as a crosstalk evaluation index. The coupling coefficient "0.1" will be referred to as a specified value. That is, the specified value is determined by the noise margin.

As is apparent from FIG. 6, as in Type B', when the ILD is made thick within the allowable range of the LSI process, the coupling coefficient between the differential transmission lines can be made small. The parallel wiring interval (e.g., the distance between the left end of the signal wiring line L1*a* of the differential transmission line L1 and the left end of the signal wiring line L2*a* of the differential transmission line L2) which satisfies K<0.1 is 14.7 μm or more in Type A, 13.4 μm or more in Type B, and 6.8 μm or more in Type B'. In this case, referring to FIG. 5C, for example, the signal wiring line L3*a* of the differential transmission line L3 is arranged at the position where the coupling coefficient K between the signal wiring line L3*a* and the adjacent differential transmission line L2 is smaller than 0.1. The parallel wiring interval in the parallel wiring structure need not always be constant.

Figure 7:
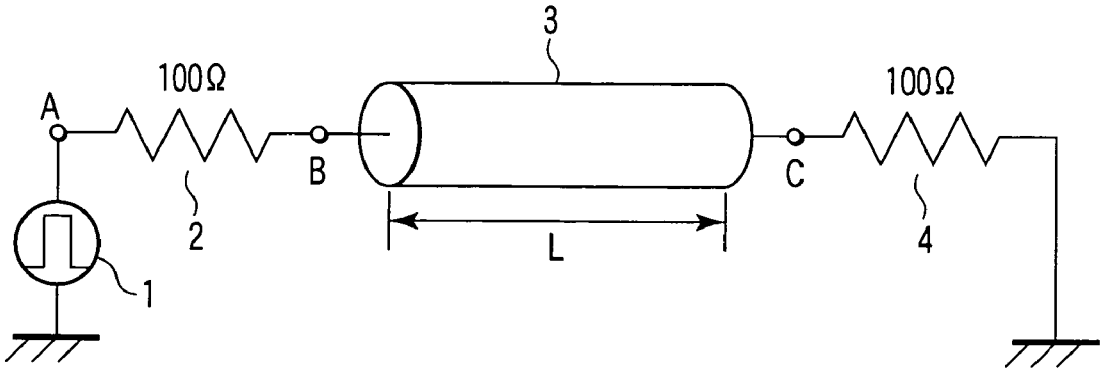
FIG. 7 is a view showing the arrangement of an eye-pattern simulation apparatus according to the first embodiment.

FIG. 7 is a view showing the arrangement of an eye-pattern simulation apparatus. Referring to FIG. 7, a random signal source 1 is connected, through a 100-Ω resistor 2, to a differential S-parameter 3 representing a differential transmission line characteristic. The differential S-parameter 3 is connected to a 100-Ω resistor 4.

To simulate eye-patterns, first, the differential S-parameter of each signal wiring line of the diagonal-pair line according to the first embodiment is obtained by using a three-dimensional electromagnetic field simulator (MW-Studio available from CST). This differential S-parameter is defined as the differential S-parameter 3 shown in FIG. 7. A pulse wave whose rise time is 5% of the period is output from the random signal source 1. The eye-pattern at a point C to be simulated is obtained by a circuit simulator (ADS (Advanced Design System) available from Agilent).

Figures 8A, 8B, 8C:
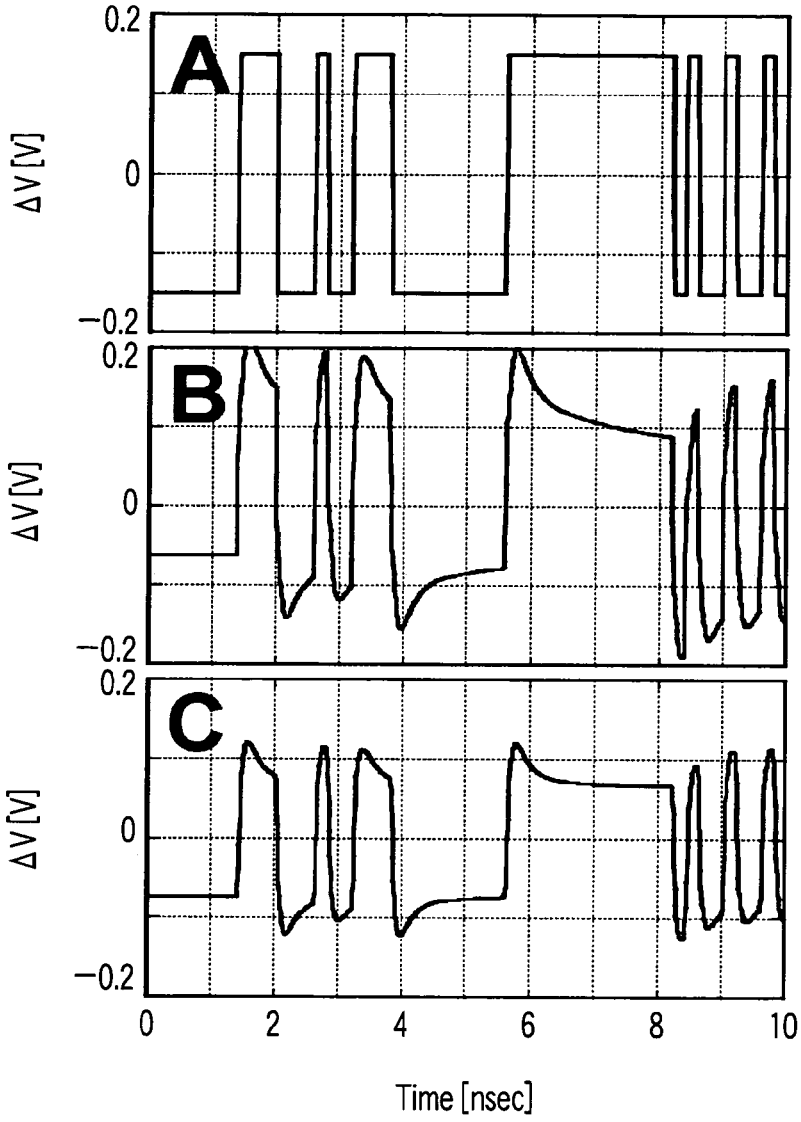
FIGS. 8A to 8C are graphs showing time domain waveforms according to the first embodiment.

FIGS. 8A, 8B, and 8C are graphs showing time domain waveforms when a transmission line length L represented by the differential S-parameter 3 is 1 cm. FIGS. 8A, 8B, and 8C show time domain waveforms at the points A, B, and C shown in FIG. 7, respectively.

Figure 9A:
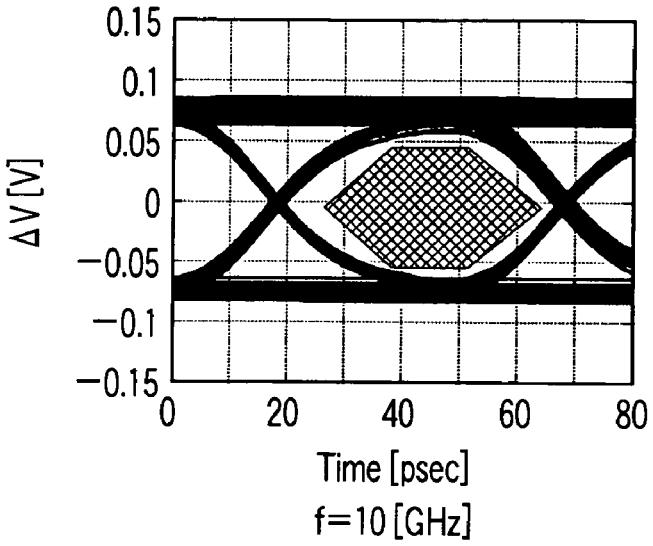
FIGS. 9A to 9B are graphs showing eye-patterns according to the first embodiment.
Figure 9B:
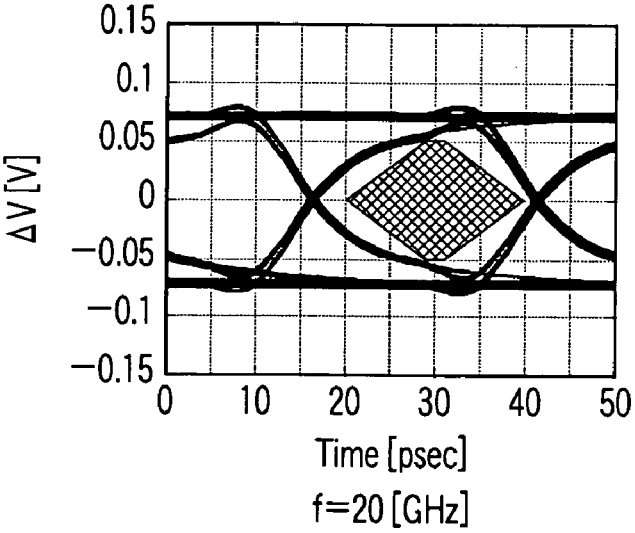

FIGS. 9A and 9B are graphs showing eye-patterns at the point C shown in FIG. 7 when the transmission line length L represented by the differential S-parameter 3 is 1 cm. FIG. 9A shows an eye-pattern when a signal frequency f is 10 GHz. FIG. 9B shows an eye-pattern when the signal frequency f is 20 GHz. These eye-patterns are derived from the time domain waveforms shown in FIG. 8C. As is apparent from FIGS. 9A and 9B, when signal frequency f=20 [GHz] or less, the eye is open. When the signal frequency is 20 GHz, a broad bandwidth of 40 Gbps can be obtained.

Figure 10A:
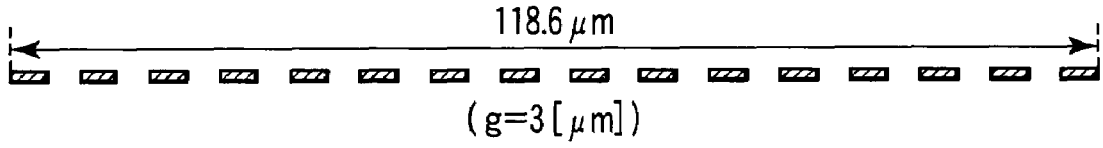
FIGS. 10A and 10B are views showing a 40-Gbps 8-bit parallel wiring structure according to the first embodiment.
Figure 10B:
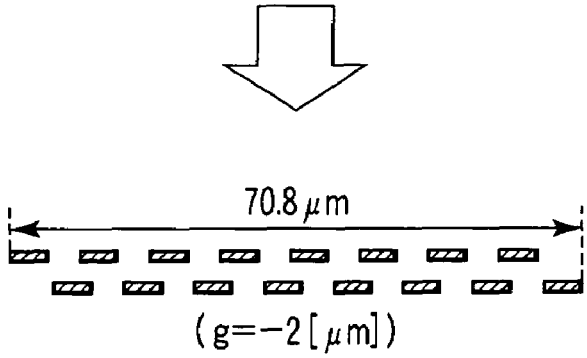

FIGS. 10A and 10B are views showing a 40-Gbps 8-bit parallel wiring structure in the LSI. FIG. 10A shows the conventional co-planar lines. FIG. 10B shows the diagonal-pair lines according to the first embodiment. When a parallel wiring is to be formed by using the conventional co-planar lines, the distance g between the differential transmission lines is 2.5 μm so that a parallel wiring width (wiring area) of 115.1 μm is necessary. To the contrary, when the diagonal-pair lines according to the first embodiment are used, the distance g is −3.8 μm, and the parallel wiring width is 58.2 μm. The parallel wiring width can be reduced by 50%. When diagonal-pair lines with a thick interlayer dielectric film are used, a parallel wiring with a broad bandwidth and low crosstalk can be implemented.

Figure 11:
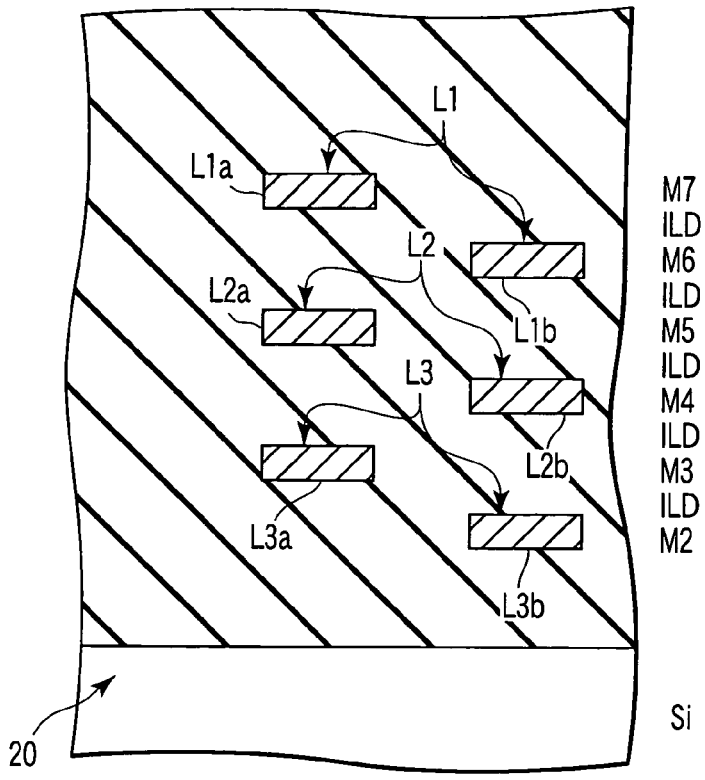
FIG. 11 is a longitudinal sectional view showing a modification of the parallel wiring structure using the differential transmission lines according to the first embodiment.

FIG. 11 is a longitudinal sectional view showing a modification of the parallel wiring structure using the differential transmission lines according to the first embodiment. FIG. 11 shows diagonal-pair lines.

The differential transmission lines L1, L2, and L3 shown in FIG. 11 are arranged in the vertical direction above an Si substrate 20 in an LSI. The differential transmission lines L1, L2, and L3 include the pairs of signal wiring lines L1*a* and L1*b*, L2*a* and L2*b*, and L3*a* and L3*b*, respectively. The signal wiring lines of each differential transmission line have a diagonal structure in which they oppose each other obliquely with respect to the vertical direction (reference direction). An ILD (interlayer dielectric film) is formed between the wiring lines of each differential transmission line and between the differential transmission lines. The signal wiring lines L1*a*, L1*b*, L2*a*, L2*b*, L3*a*, and L3*b* are made of a metal such as aluminum. The ILD is made of $SiO_2$ or the like.

Referring to FIG. 11, for example, the signal wiring line L2*a* of the differential transmission line L2 is arranged at the position where the coupling coefficient K between the signal wiring line L2*a* and the adjacent differential transmission line L1 is smaller than 0.1.

Figure 12A:
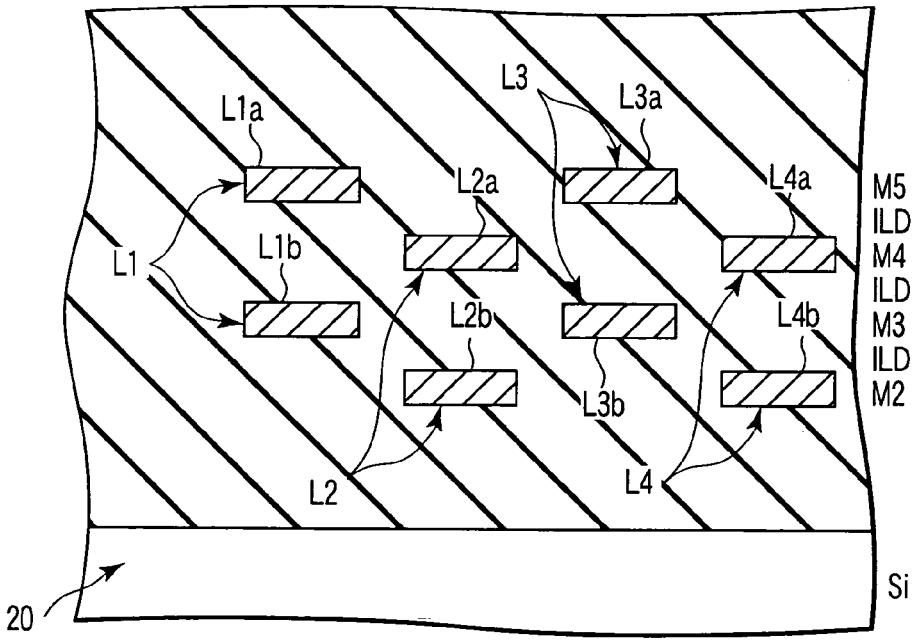
FIGS. 12A and 12B are longitudinal sectional views showing parallel wiring structures using differential transmission lines according to the second embodiment.
Figure 12B:
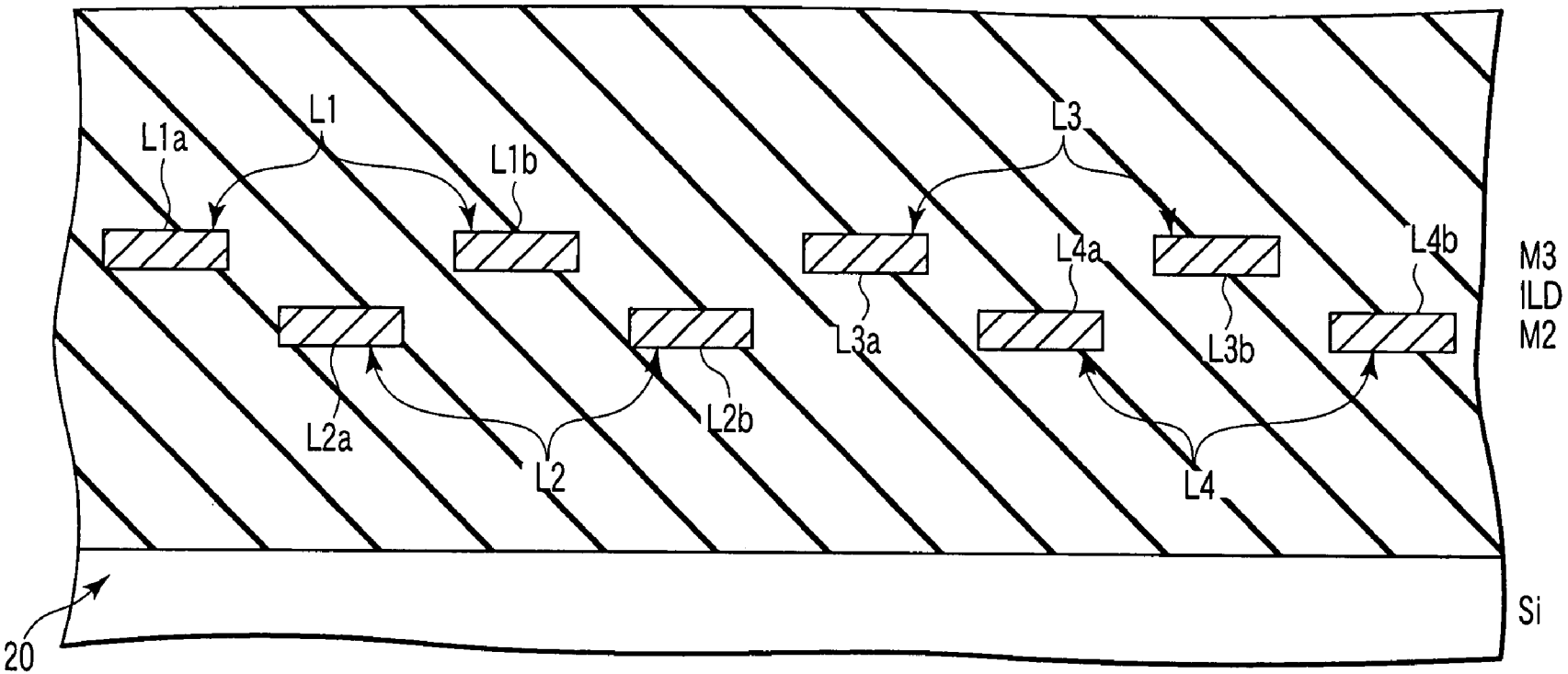

FIGS. 12A and 12B are longitudinal sectional views showing parallel wiring structures using differential transmission lines according to the second embodiment. FIG. 12A shows stacked-pair lines. FIG. 12B shows co-planar lines.

Differential transmission lines L1 and L3 shown in FIG. 12A are arranged in the horizontal direction above an Si substrate 20 in an LSI. Differential transmission lines L2 and L4 are arranged in the horizontal direction at positions lower than the differential transmission lines L1 and L3 by two layers. The differential transmission lines L1 and L3 and differential transmission lines L2 and L4 are staggered in the horizontal direction.

The differential transmission lines L1, L2, L3, and L4 include pairs of substantially parallel signal wiring lines L1*a* and L1*b*, L2*a* and L2*b*, L3*a* and L3*b*, and L4*a* and L4*b*, respectively. The signal wiring lines of each differential transmission line are arranged in the vertical direction (reference direction). The signal wiring line L2*a* of the differential transmission line L2 opposes the signal wiring lines L1*a* and L1*b* of the differential transmission line L1, which are adjacent to the signal wiring line L2*a*, obliquely with respect to the vertical direction. In addition, the signal wiring line L4*a* of the differential transmission line L4 opposes the signal wiring lines L3*a* and L3*b* of the differential transmission line L3, which are adjacent to the signal wiring line L4*a*, obliquely with respect to the vertical direction.

An ILD (interlayer dielectric film) is formed between the wiring lines of each differential transmission line and between the differential transmission lines. The signal wiring lines L1*a*, L1*b*, L2*a*, L2*b*, L3*a*, L3*b*, L4*a*, and L4*b* are made of a metal such as aluminum. The ILD is made of $SiO_2$ or the like.

Referring to FIG. 12A, for example, the signal wiring line L2*a* of the differential transmission line L2 is arranged at the position where a coupling coefficient K between the signal wiring line L2*a* and the adjacent differential transmission line L1 is smaller than 0.1.

The differential transmission lines L1 and L3 shown in FIG. 12B are arranged in the horizontal direction above an Si substrate 20 in an LSI. The differential transmission lines L2 and L4 are arranged in the horizontal direction in a layer on the upper or lower side of the differential transmission lines L1 and L3. The differential transmission lines L1 and L3 and differential transmission lines L2 and L4 are staggered in the horizontal direction.

The differential transmission lines L1, L2, L3, and L4 include the pairs of substantially parallel signal wiring lines L1*a* and L1*b*, L2*a* and L2*b*, L3*a* and L3*b*, and L4*a* and L4*b*, respectively. The signal wiring lines of each differential transmission line are arranged in the horizontal direction (reference direction). The signal wiring line L2*a* of the differential transmission line L2 opposes the signal wiring lines L1*a* and L1*b* of the differential transmission line L1, which are adjacent to the signal wiring line L2*a*, obliquely with respect to the horizontal direction. In addition, the signal wiring line L4*a* of the differential transmission line L4 opposes the signal wiring lines L3*a* and L3*b* of the differential transmission line L3, which are adjacent to the signal wiring line L4*a*, obliquely with respect to the horizontal direction. The differential transmission lines L1 and L3 and differential transmission lines L2 and L4 shown in FIG. 12B may be present in the same horizontal plane.

An ILD (interlayer dielectric film) is formed between the wiring lines of each differential transmission line and between the differential transmission lines. The signal wiring lines L1*a*, L1*b*, L2*a*, L2*b*, L3*a*, L3*b*, L4*a*, and L4*b* are made of a metal such as aluminum. The ILD is made of $SiO_2$ or the like.

Referring to FIG. 12B, for example, the signal wiring line L2*a* of the differential transmission line L2 is arranged at the position where the coupling coefficient K between the signal wiring line L2*a* and the adjacent differential transmission line L1 is smaller than 0.1.

Figure 13A:
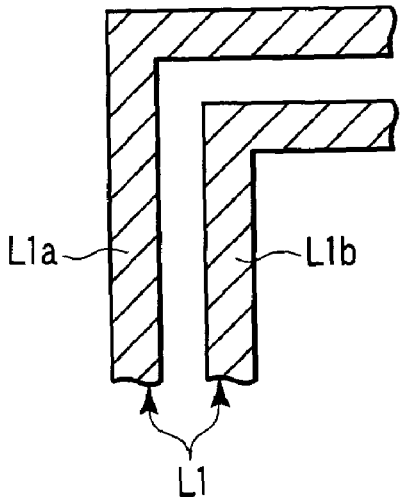
FIGS. 13A to 13C are plan views showing parallel wiring structures using differential transmission lines according to the prior art and the third embodiment.
Figure 13B:
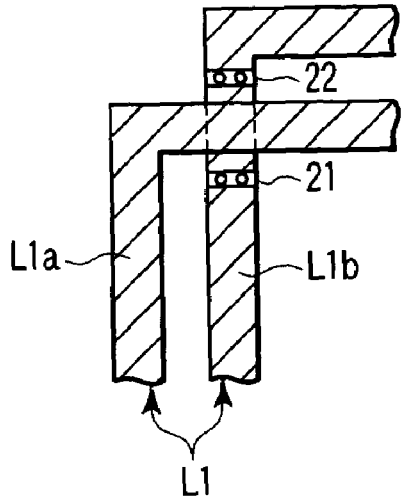
Figure 13C:
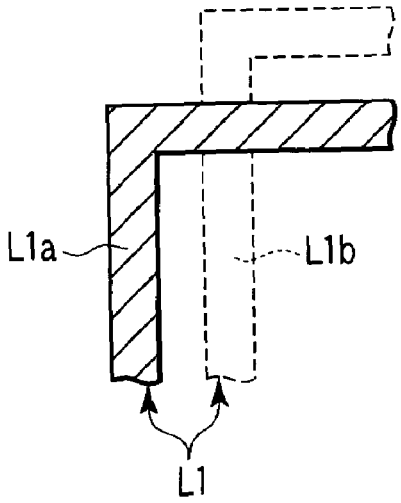

FIGS. 13A, 13B, and 13C are plan views showing parallel wiring structures using differential transmission lines according to the prior art and the third embodiment. FIGS. 13A and 13B show the conventional co-planar lines. FIG. 13C shows a diagonal-pair line according to the third embodiment.

A pair of substantially parallel signal wiring lines L1*a* and L1*b* are bent and arranged in an LSI. In the conventional co-planar lines, the lengths of the signal wiring lines L1*a* and L1*b* are different, as shown in FIG. 13A. To equalize the lengths, one of the signal wiring lines L1*b* and L1*a* must be led to the lower layer through via holes 21 and 22, as shown in FIG. 13B, while crossing without coming into contact with each other.

In the diagonal-pair line according to the third embodiment, the signal wiring lines L1*a* and L1*b* are formed in different layers, as shown in FIG. 13C. Hence, the signal wiring lines can cross without coming into contact with each other. Accordingly, the signal wiring lines can have the same length.

Figure 14:
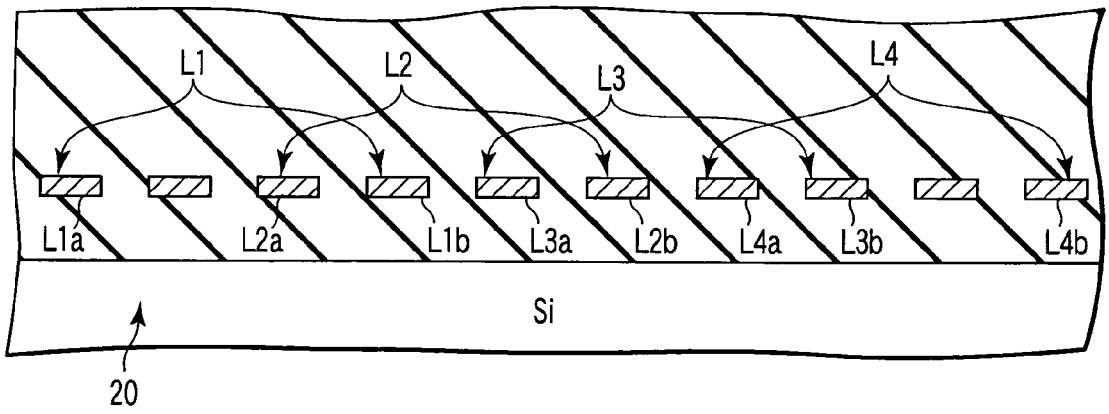
FIG. 14 is a longitudinal sectional view showing a parallel wiring structure using differential transmission lines according to the fourth embodiment.

FIG. 14 is a longitudinal sectional view showing a parallel wiring structure using differential transmission lines according to the fourth embodiment.

Differential transmission lines L1, L2, L3, and L4 shown in FIG. 14 are arranged in the horizontal direction above an Si substrate 20 in an LSI. The differential transmission lines L1, L2, L3, and L4 include pairs of substantially parallel signal wiring lines L1*a* and L1*b*, L2*a* and L2*b*, L3*a* and L3*b*, and L4*a* and L4*b*, respectively. Referring to FIG. 14, for example, the signal wiring lines L1*b* and L3*a* are arranged between the signal wiring lines L2*a* and L2*b*. The signal wiring lines L2*b* and L4*a* are arranged between the signal wiring lines L3*a* and L3*b*.

Referring to FIG. 14, for example, the signal wiring line L3*a* of the differential transmission line L3 is arranged at the position where a coupling coefficient K between the signal wiring line L3*a* and the adjacent differential transmission line L2 is smaller than 0.1.

As described above, according to the first to fourth embodiments, when diagonal-pair lines in which the signal wiring lines are arranged obliquely are used, crosstalk can be reduced even when the signal wiring lines are arranged in parallel in close vicinity. Hence, the tradeoff relationship between the crosstalk and the wiring area, which poses a problem in the conventional parallel wiring, does not hold. There is no tradeoff relationship between the characteristic impedance and the wiring resistance. Even when a pair of wiring lines are bent, they have the same length. No ground plane is necessary. A ground plane may be present, as a matter of course.

That is, a parallel wiring which is excellent in all of crosstalk, wiring area, characteristic impedance, long-distance signal transmission characteristic, bending, and cost can be implemented, unlike the conventional parallel wiring using differential transmission lines.

Additionally, when the wiring lines of differential transmission lines are arranged in a staggered pattern, the influence of crosstalk and the distance between the wiring lines can be reduced. This structure is therefore more effective than the conventional co-planar lines or stacked-pair line. When differential transmission lines resistant to in-phase noise are introduced in an LSI, the crosstalk robustness of the parallel wiring increases so that a parallel wiring structure with a broad bandwidth and low crosstalk can be implemented. As described above, according to the embodiments, a parallel wiring and an integrated circuit, which have a high wiring density and low crosstalk between differential wiring lines, can be implemented.

In recent development of high-speed electronic devices, it is essential to suppress EMI (ElectroMagnetic Interference) noise in LSIs as described above. Many of wiring lines in an LSI have uncertain current return paths and large characteristic impedances. For this reason, the wiring lines act as a main EMI noise generation source.

Recent LSIs using Si substrates execute digital signal processing on GHz or more order with a chip size of about 1 cm as the operation speed and degree of integration are increased by microfabrication. For this reason, the signal wavelength and the long-distance wiring length in LSIs are on same order. The long-distance wiring lines can become antennas.

When long-distance wiring lines are designed as transmission lines, the electromagnetic field can be concentrated in the transmission lines, and EMI noise can be reduced. Since a differential transmission line has excellent crosstalk robustness, signal transmission at a small amplitude is possible. Hence, when differential transmission lines are used, EMI can be reduced as compared to unbalanced transmission lines.

In the first to fourth embodiments, differential transmission lines having a diagonal structure as shown in FIG. 1 are used as long-distance wiring lines in an LSI. When this wiring structure is used, the above-described bus line with a high wiring density and low crosstalk can be implemented. However, when, e.g., the differential transmission lines L1, L2, and L3 shown in FIG. 1 are formed in an LSI, loss is larger in the wiring lines L1*b*, L2*b*, and L3*b* close to the Si substrate than in the wiring lines L1*a*, L2*a*, and L3*a* far apart from the Si substrate. Since the loss in the wiring lines L1*b*, L2*b*, and L3*b* and that in the wiring lines L1*a*, L2*a*, and L3*a* are unbalanced, a common mode component is generated. Of the modes of a signal propagating through a differential transmission line, the common mode largely contributes to electromagnetic radiation. Hence, as a measure to EMI in a differential transmission line, it is important to reduce the common mode, i.e. mode conversion.

In the fifth embodiment, a twisted diagonal-pair line which reduces the mode conversion will be considered.

Figure 15:
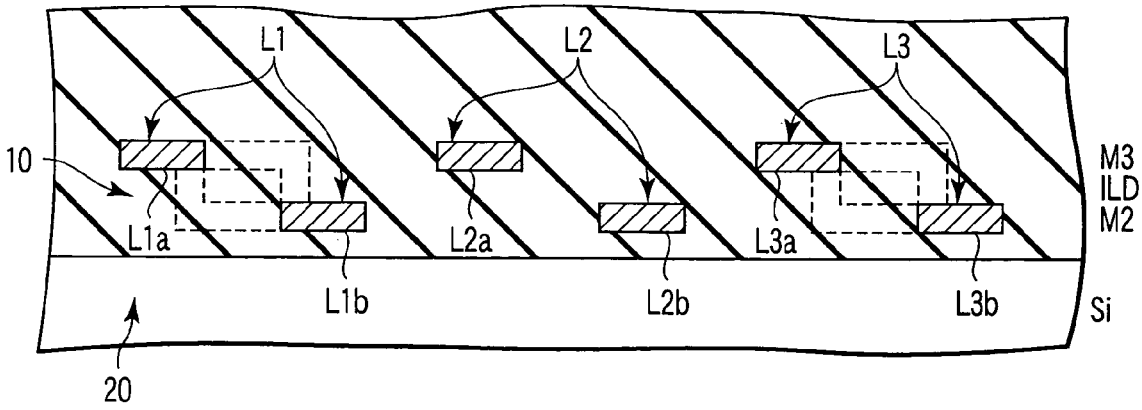
FIG. 15 is a longitudinal sectional view showing a parallel wiring structure using twisted differential transmission lines according to the fifth embodiment.
Figure 16:
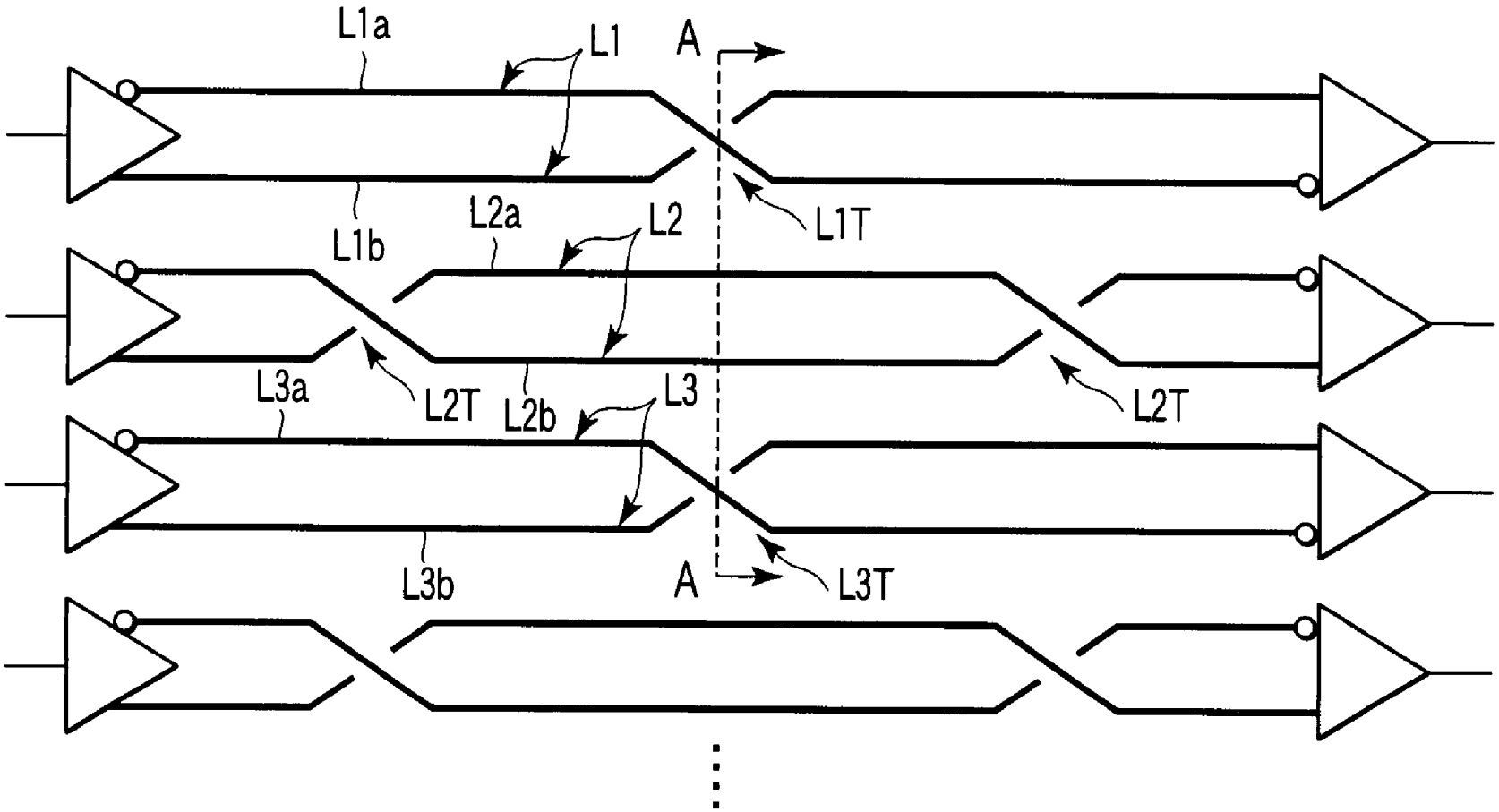
FIG. 16 is a schematic plan view of the parallel wiring shown in FIG. 15.

FIG. 15 is a longitudinal sectional view showing a parallel wiring structure using twisted differential transmission lines according to the fifth embodiment. FIG. 15 shows twisted diagonal-pair lines. FIG. 16 is a schematic plan view of the parallel wiring shown in FIG. 15. The same reference numerals as in FIG. 1 denote the same parts in FIGS. 15 and 16. FIG. 15 is a sectional view taken along a line A-A in FIG. 16.

Differential transmission lines L1, L2, and L3 shown in FIGS. 15 and 16 are arranged in the horizontal direction above an Si substrate 20 in an LSI. The differential transmission lines L1, L2, and L3 include pairs of substantially parallel signal wiring lines L1*a* and L1*b*, L2*a* and L2*b*, and L3*a* and L3*b*, respectively. The signal wiring lines of each differential transmission line have a diagonal structure in which they oppose each other obliquely with respect to the horizontal direction (reference direction). An ILD (interlayer dielectric film) 10 is formed between the wiring lines of each differential transmission line.

In the differential transmission lines L1, L2, and L3, the signal wiring lines L1*a*, L2*a*, and L3*a* of the M3 layer and the signal wiring lines L1*b*, L2*b*, and L3*b* of the M2 layer cross and replace their positions at predetermined twisted portions L1T, L2T, and L3T in the longitudinal direction without coming into contact with each other.

In, e.g., the differential transmission line L1, the signal wiring line L1*a* of the M3 layer runs downward from the M3 layer to the M2 layer via the ILD layer at the twisted portion L1T, and the signal wiring line L1*b* of the M2 layer runs upward from the M2 layer to the M3 layer via the ILD layer at the same twisted portion L1T. In this case, the signal wiring lines L1*a* and L1*b* do not come into contact with each other at the twisted portion L1T, as will be described later. The twisted portion L1T of the differential transmission line L1 is located substantially at the intermediate portion between the two twisted portions L2T, L2T of the differential transmission line L2 adjacent to the differential transmission line L1. This also applies to the relationship between the adjacent differential transmission lines L2 and L3 and the relationship between Ln and Ln+1 (n=1, 2, 3 . . . )

Figure 17:
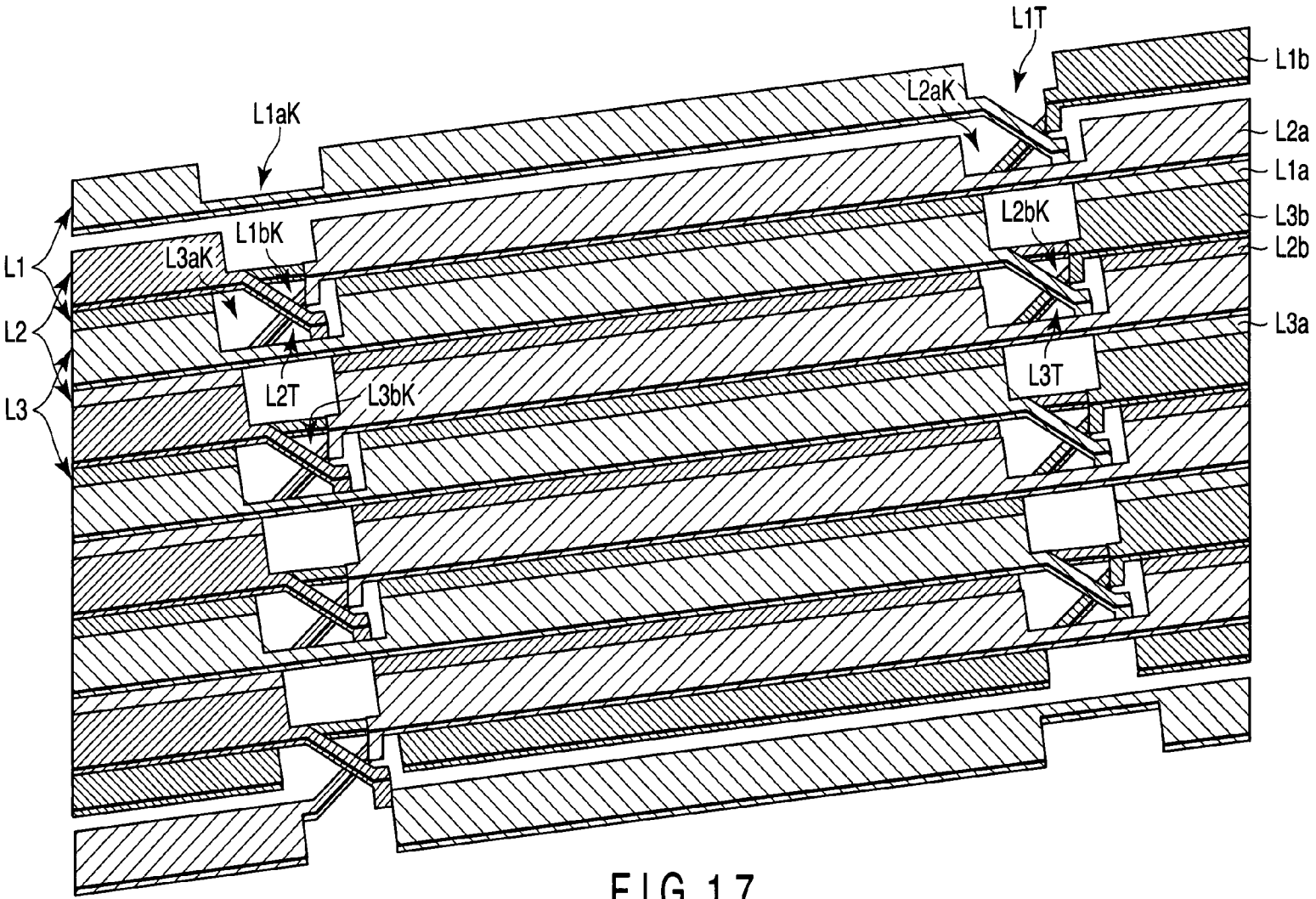
FIG. 17 is a view showing the structure of twisted diagonal-pair lines according to the fifth embodiment.

FIG. 17 is a view showing the structure of the above-described twisted diagonal-pair lines. FIG. 17 is a perspective view showing the diagonal-pair lines shown in FIG. 10B to which the twisted diagonal-pair line structure of the fifth embodiment is applied. Referring to FIG. 17, notch portions L1*a*K, L1*b*K, L2*a*K, L2*b*K, L3*a*K, L3*b*K, . . . are formed in the signal wiring lines L1*a*, L1*b*, L2*a*, L2*b*, L3*a*, L3*b*, . . . of the differential transmission lines L1, L2, L3, . . . which are adjacent to the twisted portions L1T, L2T, L3T, . . . of the differential transmission lines L1, L2, L3, . . . . Referring to FIG. 17, for example, the notch portion L2*a*K is formed near the twisted portion L1T, and the notch portion L3*a*K is formed near the twisted portion L2T. With this structure, when the signal wiring lines L1*a*, L2*a*, L3*a*, . . . and the signal wiring lines L1*b*, L2*b*, L3*b*, . . . cross and replace their positions at the twisted portions L1T, L2T, L3T, . . . without coming into contact with each other, the signal wiring lines L1*a*, L1*b*, L2*a*, L2*b*, L3*a*, L3*b*, . . . do not come into contact with neighboring signal wiring lines.

Figure 18A:
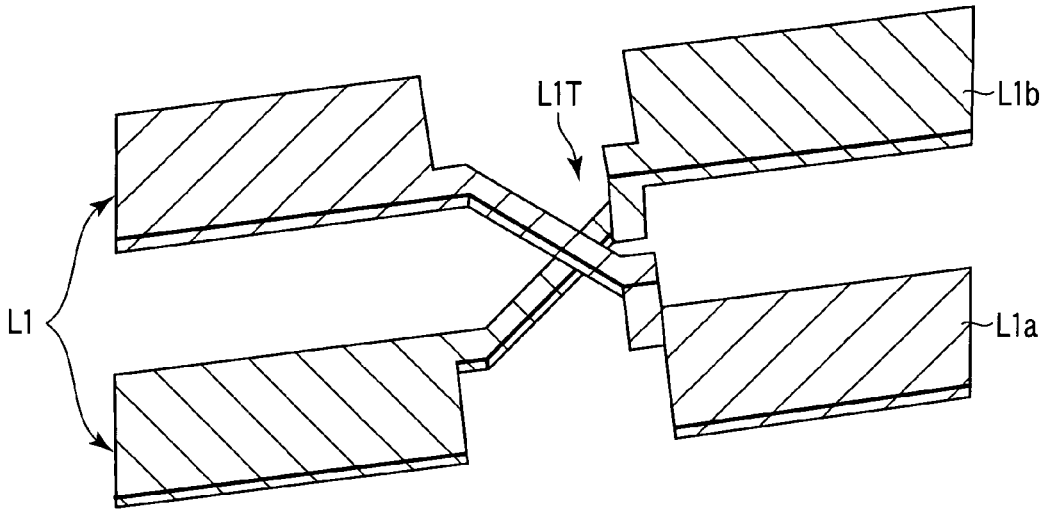
FIGS. 18A and 18B are enlarged perspective views showing the twisted portions of the diagonal-pair line shown in FIG. 17.
Figure 18B:
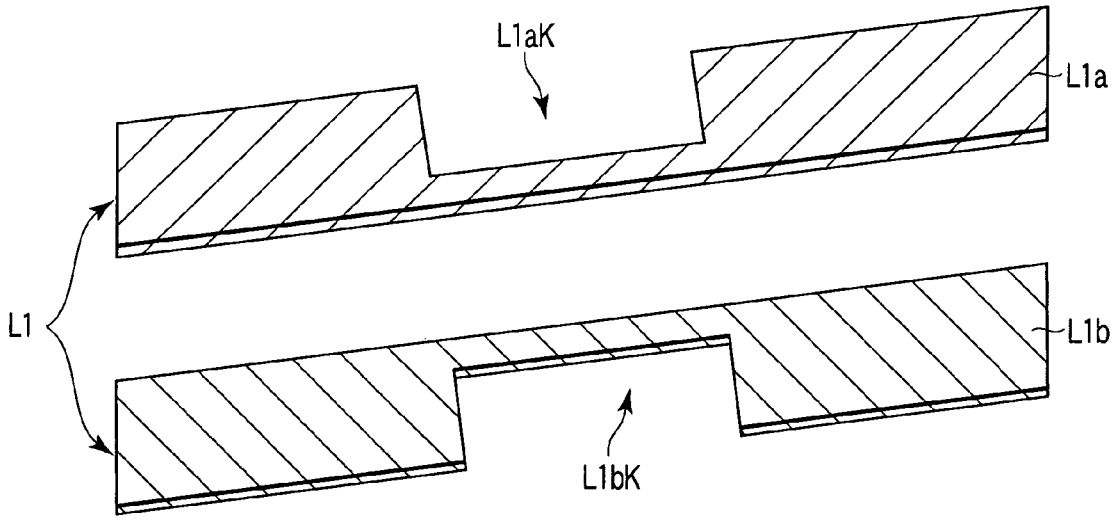

FIGS. 18A and 18B are enlarged perspective views showing the twisted portions of the diagonal-pair line shown in FIG. 17. FIG. 18A shows a twisted portion. FIG. 18B shows notch portions. As shown in FIG. 18A, each of the signal wiring lines L1*a* and L1*b* at the twisted portion L1T has a length of about 10 μm and a width of about 1 μm. As shown in FIG. 18B, each of the notch portions L1*a*K and L1*b*K has a length of about 12 μm and a width of about 1 μm. The length of each of the twisted portions L1T, L2T, L3T, . . . is much shorter than the length of each of the signal wiring lines L1*a*, L1*b*, L2*a*, L2*b*, L3*a*, L3*b*, . . . For this reason, loss at the twisted portions is much smaller than that in all lines.

Figure 19:
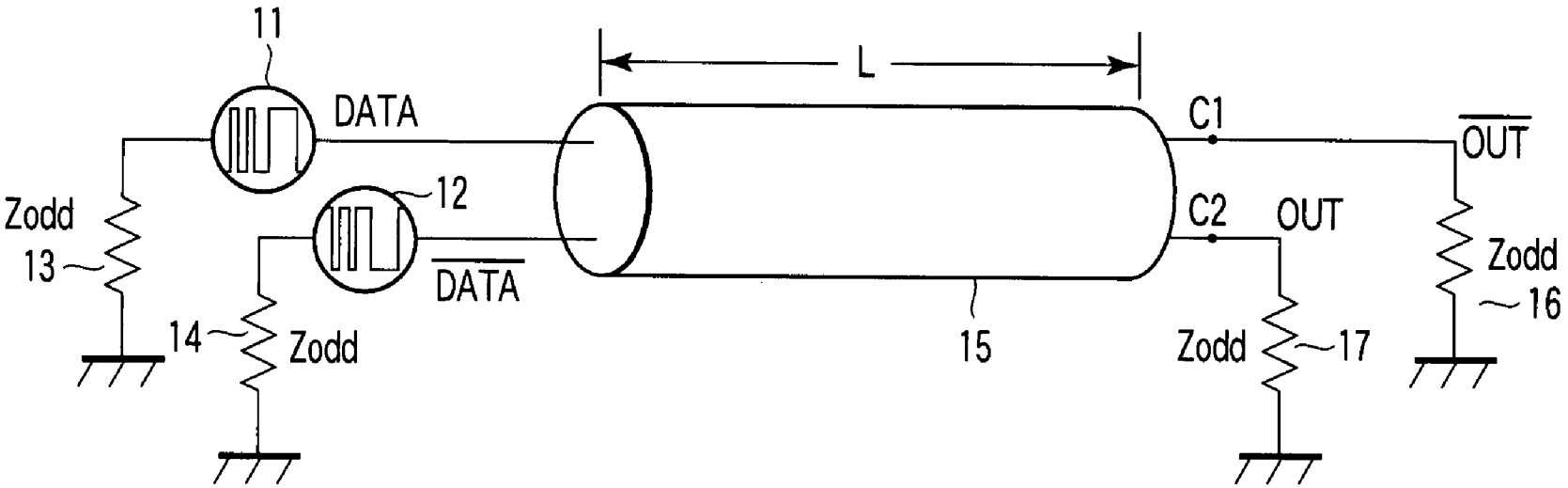
FIG. 19 is a view showing the arrangement of an eye-pattern simulation apparatus according to the fifth embodiment.

FIG. 19 is a view showing the arrangement of an eye-pattern simulation apparatus according to the fifth embodiment. Referring to FIG. 19, random signal sources 11 and 12 are connected to 50-Ω resistors 13 and 14, respectively, and a four-terminal S-parameter 15 representing a differential transmission line characteristic. The four-terminal S-parameter 15 is connected to 50-Ω resistors 16 and 17.

To simulate eye-patterns, the four-terminal S-parameter of each signal wiring line of the diagonal-pair line according to the first embodiment and the twisted diagonal-pair line according to the fifth embodiment is obtained by using a three-dimensional electromagnetic field simulator (MW-Studio available from CST). This four-terminal S-parameter is defined as the four-terminal S-parameter 15 shown in FIG. 19. Differential pseudo random number bit sequences (PRBS) are output from the random signal sources 11 and 12 to the four-terminal S-parameter 15. By using a circuit simulator (ADS (Advanced Design System) available from Agilent), a time domain waveform is generated, and eye-patterns at points C1 and C2 to be simulated are obtained. The voltage of PRBS is 0.30 Vp-p. The eye-pattern diagram is generated by using differential output waveforms (OUT and $\overline{\text{OUT}}$).

Figure 20A:
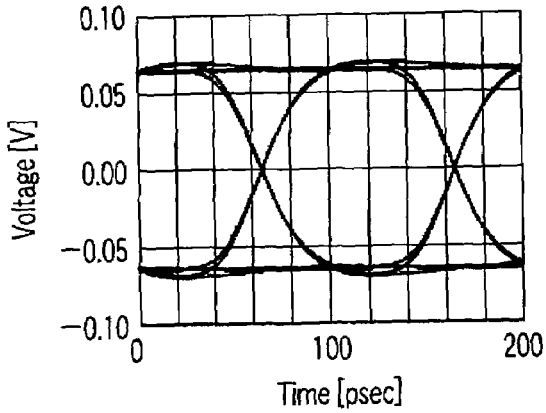
FIGS. 20A to 20D are graphs showing eye-patterns and a common mode noise waveform of a diagonal-pair line according to the first embodiment.
Figure 20B:
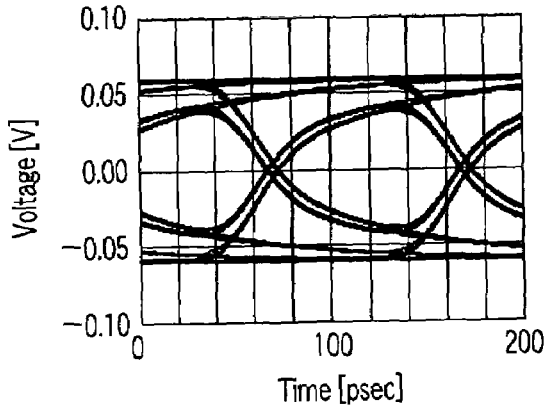
Figure 20C:
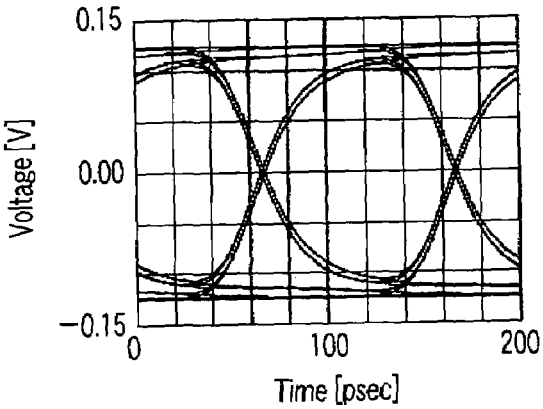
Figure 20D:
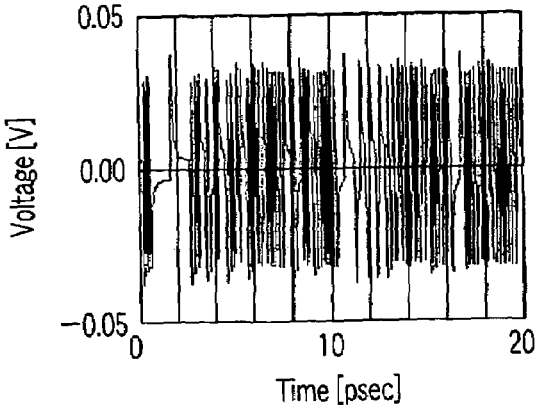

FIGS. 20A, 20B, and 20C are graphs related to the diagonal-pair line according to the first embodiment. FIGS. 20A to 20C are graphs showing eye-patterns at the points C1 and C2 when a length L of a transmission line represented by the four-terminal S-parameter 15 shown in FIG. 19 is 1 cm, and the signal speed is 10 Gbps. FIG. 20A shows the eye-pattern of a signal wiring line of the M3 layer. FIG. 20B shows the eye-pattern of a signal wiring line of the M2 layer. FIG. 20C shows the eye-pattern of a differential mode. FIG. 20D is a graph showing the waveform of common mode noise in that case.

As shown in FIGS. 20A and 20B, attenuation in the signal wiring line of the M2 layer is larger than in the signal wiring line of the M3 layer. This is because the signal wiring line of the M2 layer is closer to the Si substrate 20 than the signal wiring line of the M3 layer and is therefore more largely affected by the Si substrate 20 to result in larger loss. Hence, as shown in FIG. 20D, common mode noise is generated due to unbalanced attenuation between the signal wiring line of the M2 layer and that of the M3 layer. The common mode voltage is 0.08 Vp-p and generates EMI noise. In the diagonal-pair line according to the first embodiment, the power of EMI noise can be reduced by 27 dB as compared to a conventional long-distance wiring line with a signal voltage of 1.8 Vp-p. A common mode current generates electromagnetic radiation and crosstalk noise which are much larger than those by a differential mode current. For this reason, it is important for a GHz-LSI to reduce the common mode current in a long-distance wiring line.

Figure 21A:
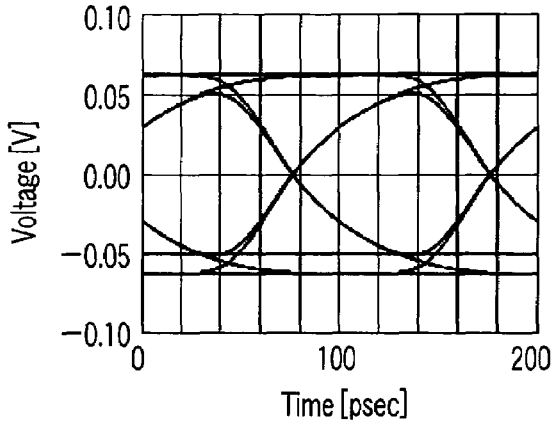
FIGS. 21A to 21D are graphs showing eye-patterns and a common mode noise waveform of a diagonal-pair line according to the fifth embodiment.
Figure 21B:
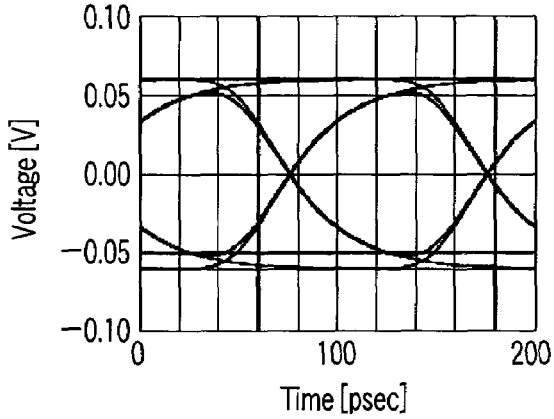
Figure 21C:
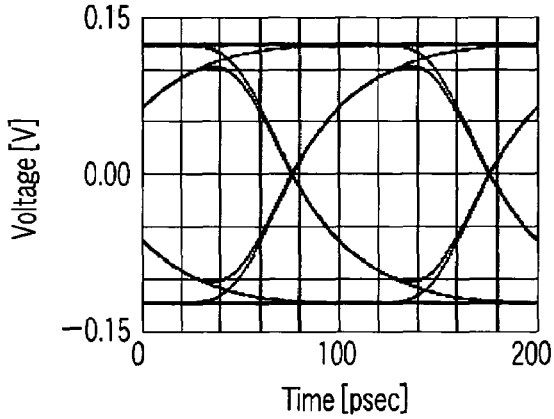
Figure 21D:
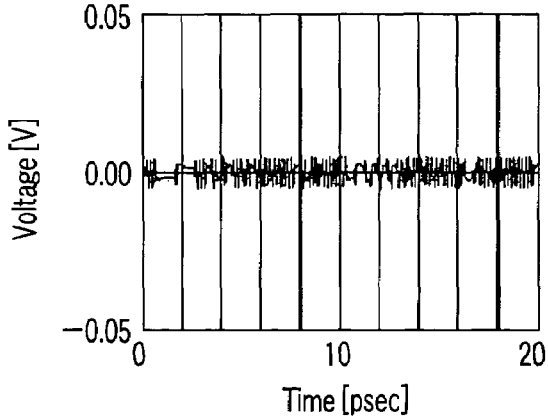

FIGS. 21A, 21B, and 21C are graphs related to the twisted diagonal-pair line according to the fifth embodiment. FIGS. 21A to 21C are graphs showing eye-patterns at the points C1 and C2 when the length L of the transmission line represented by the four-terminal S-parameter 15 shown in FIG. 19 is 1 cm, and the signal speed is 10 Gbps. FIG. 21A shows the eye-pattern of a signal wiring line of the M3 layer. FIG. 21B shows the eye-pattern of a signal wiring line of the M2 layer. FIG. 21C shows the eye-pattern of a differential mode. FIG. 21D is a graph showing the waveform of common mode noise in that case.

As shown in FIGS. 21A and 21B, in the twisted diagonal-pair line, loss in the signal wiring line of the M2 layer and that in the signal wiring line of the M3 layer by the Si substrate 20 are averaged so that attenuation in the signal wiring line of the M2 layer equals that in the signal wiring line of the M3 layer. In the twisted diagonal-pair line according to the fifth embodiment, the common mode power can be reduced by 20 dB as compared to the diagonal-pair line according to the first embodiment. In addition, the common mode power can be reduced by 47 dB as compared to the conventional long-distance wiring line. For this reason, in the twisted diagonal-pair line according to the fifth embodiment, EMI noise can dramatically be reduced on the long-distance wiring line.

Figure 22:
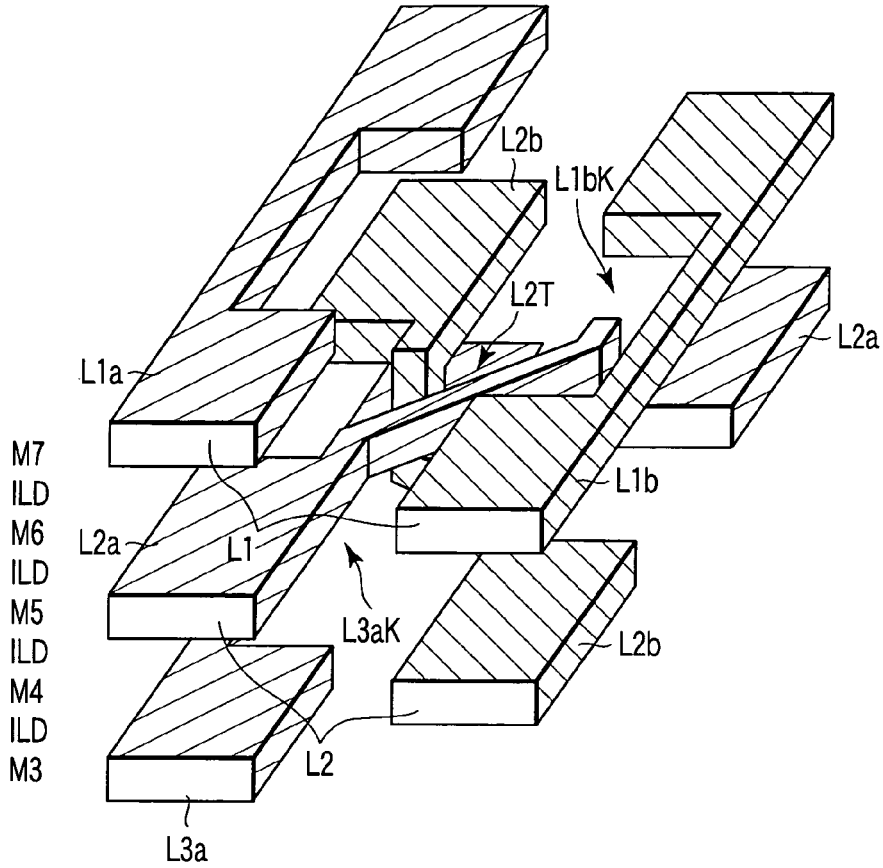
FIG. 22 is a partial perspective view showing the parallel wiring structure shown in FIG. 11 to which a twisted diagonal-pair line structure according to the fifth embodiment is applied.

FIG. 22 is a partial perspective view showing the parallel wiring structure shown in FIG. 11 to which the twisted diagonal-pair line structure according to the fifth embodiment is applied. Referring to FIG. 22, the notch portions L1*b*K and L3*a*K are formed in the signal wiring lines L1*b* and L3*a* of the differential transmission lines L1 and L3 which are adjacent to the twisted portion L2T of the differential transmission line L2. With this structure, when the signal wiring lines L2*a* and L2*b* cross and replace their positions at the twisted portion L2T without coming into contact with each other (the signal wiring line L2*a* runs from an M5 layer to an M4 layer, and the signal wiring line L2*b* runs from the M4 layer to the M5 layer), the signal wiring lines L2*a* and L2*b* do not come into contact with the neighboring signal wiring lines L1*b* and L3*a*. More specifically, the signal wiring line L2*a* decreases its width and runs obliquely in the M5 layer, and runs downward from the M5 layer to the M4 layer via the ILD layer. In the M4 layer, the width returns to the original width. In this state, the signal wiring line L2*a* runs in the virtual (phantom) extending direction of the signal wiring line L2*b* in the M4 layer. The signal wiring line L2*b* decreases its width and runs obliquely in the M4 layer, and runs upward from the M4 layer to the M5 layer via the ILD layer. In the M5 layer, the width returns to the original width. In this state, the signal wiring line L2*b* runs in the virtual extending direction of the signal wiring line L2*a* in the M5 layer.

Figure 23:
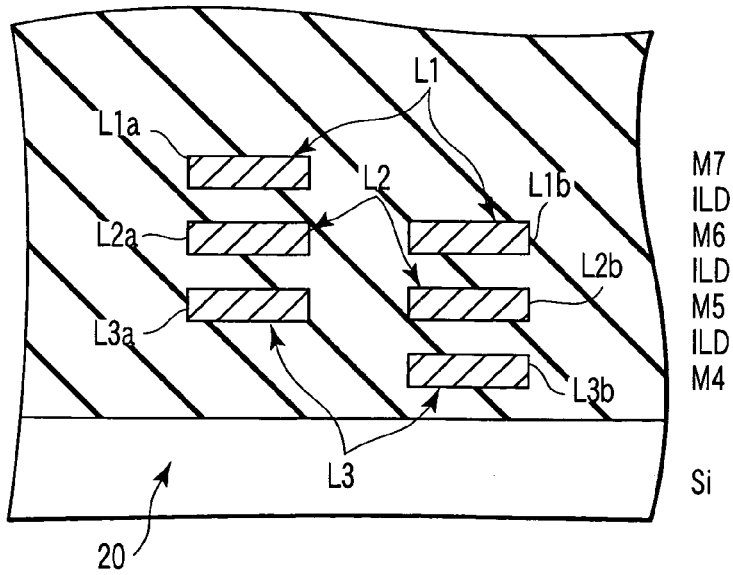
FIG. 23 is a longitudinal sectional view showing a modification of the parallel wiring structure using differential transmission lines according to the fifth embodiment.

FIG. 23 is a longitudinal sectional view showing a modification of the parallel wiring structure using the differential transmission lines according to the fifth embodiment. FIG. 23 shows twisted diagonal-pair lines.

The differential transmission lines L1, L2, and L3 shown in FIG. 23 are arranged in the vertical direction above an Si substrate 20 in an LSI. The differential transmission lines L1, L2, and L3 include the pairs of signal wiring lines L1*a* and L1*b*, L2*a* and L2*b*, and L3*a* and L3*b*, respectively. The signal wiring lines of each differential transmission line have a diagonal structure in which they oppose each other obliquely with respect to the vertical direction (reference direction). An ILD (interlayer dielectric film) is formed between the wiring lines of each differential transmission line and between the differential transmission lines.

In two adjacent differential transmission lines, the lower signal wiring line of a differential transmission line and the upper signal wiring line of the other differential transmission line are located in the same layer. For example, the signal wiring line L1*b* of the differential transmission line L1 and the signal wiring line L2*a* of the differential transmission line L2 are located in an M6 layer. The signal wiring lines L1*a*, L1*b*, L2*a*, L2*b*, L3*a*, and L3*b* are made of a metal such as aluminum. The ILD is made of $SiO_2$ or the like.

Figure 24:
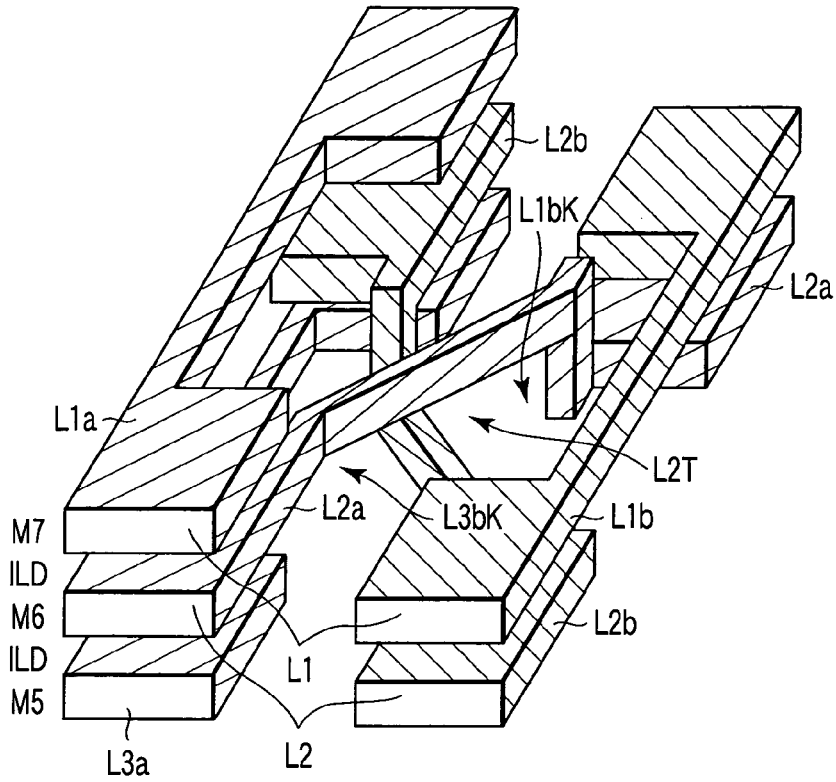
FIG. 24 is a partial perspective view of the parallel wiring structure shown in FIG. 23.

FIG. 24 is a partial perspective view showing the parallel wiring structure shown in FIG. 23. Referring to FIG. 24, the notch portions L1*b*K and L3*a*K are formed in the signal wiring lines L1*b* and L3*a* of the differential transmission lines L1 and L3 which are adjacent to the twisted portion L2T of the differential transmission line L2. With this structure, when the signal wiring lines L2*a* and L2*b* cross and replace their positions at the twisted portion L2T without coming into contact with each other (the signal wiring line L2*a* runs from the M6 layer to the M5 layer, and the signal wiring line L2*b* runs from the M5 layer to the M6 layer), the signal wiring lines L2*a* and L2*b* do not come into contact with the neighboring signal wiring lines L1*b* and L3*a*. More specifically, the signal wiring line L2*a* decreases its width and runs obliquely in the M6 layer, and runs downward from the M6 layer to the M5 layer via the ILD layer. In the M5 layer, the width returns to the original width. In this state, the signal wiring line L2*a* runs in the virtual extending direction of the signal wiring line L2*b* in the M5 layer. The signal wiring line L2*b* decreases its width and runs obliquely in the M5 layer, and runs upward from the M5 layer to the M6 layer via the ILD layer. In the M6 layer, the width returns to the original width. In this state, the signal wiring line L2*b* runs in the virtual extending direction of the signal wiring line L2*a* in the M6 layer.

In the structure shown in FIG. 24, the vertical distance (thickness) of the entire parallel wiring can be shortened as compared to FIG. 22. In addition, the common mode component can be reduced by the twisted diagonal-pair line structure above the Si substrate. Hence, EMI noise can be suppressed. In addition, since the twisted diagonal-pair line structure is applied, crosstalk of the differential mode and common mode can be reduced as a secondary effect.

Figure 25:
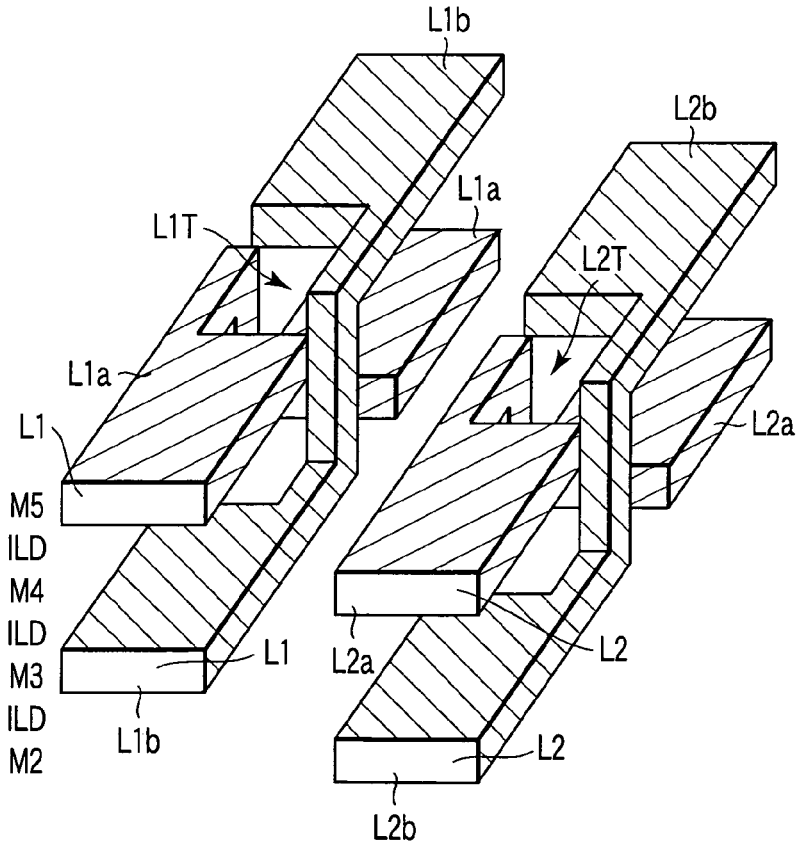
FIG. 25 is a partial perspective view showing the parallel wiring structure shown in FIG. 12A to which the twisted pair line structure according to the fifth embodiment is applied.

FIG. 25 is a partial perspective view showing the parallel wiring structure shown in FIG. 12A to which the twisted pair line structure according to the fifth embodiment is applied. Referring to FIG. 25, the signal wiring lines L1*a* and L1*b* of the differential transmission line L1 and the signal wiring lines L2*a* and L2*b* of the differential transmission line L2 cross and replace their positions at the twisted portions L1T and L2T, respectively, without coming into contact with each other (the signal wiring line L1*a* runs from the M5 layer to the M3 layer, the signal wiring line L1*b* runs from the M3 layer to the M5 layer, the signal wiring line L2*a* runs from the M4 layer to the M2 layer, and the signal wiring line L2*b* runs from the M2 layer to the M4 layer). Hence, the signal wiring lines L1*a*, L1*b*, L2*a*, and L2*b* do not come into contact with the neighboring signal wiring lines. More specifically, in the differential transmission line L1, the signal wiring line L1*a* decreases its width in the M5 layer and runs in this state downward from the M5 layer to the M3 layer via the ILD layer, M4 layer, and ILD layer. The signal wiring line L1*a* runs in the virtual extending direction of the signal wiring line L1*b* in the M3 layer. The width returns to the original width. The signal wiring line L1*b* decreases its width in the M3 layer and runs in this state upward from the M3 layer to the M5 layer via the ILD layer, M4 layer, and ILD layer. The signal wiring line L1*b* runs in the virtual extending direction of the signal wiring line L1*a* in the M5 layer. The width returns to the original width. This also applied to the differential transmission line L2.

Figure 26:
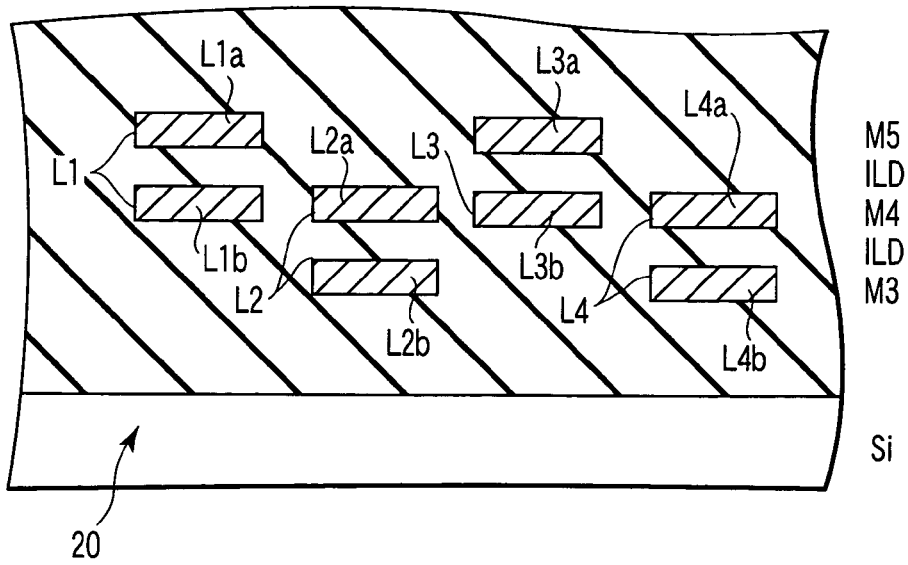
FIG. 26 is a longitudinal sectional view showing a modification of the parallel wiring structure using the differential transmission lines according to the fifth embodiment.

FIG. 26 is a longitudinal sectional view showing a modification of the parallel wiring structure using the differential transmission lines according to the fifth embodiment. FIG. 26 shows twisted stacked-pair lines.

The differential transmission lines L1 and L3 shown in FIG. 26 are arranged in the horizontal direction above an Si substrate 20 in an LSI. The differential transmission lines L2 and L4 are arranged in the horizontal direction at positions lower than the differential transmission lines L1 and L3 by two layers. The differential transmission lines L1 and L3 and differential transmission lines L2 and L4 are staggered in the horizontal direction.

The differential transmission lines L1, L2, L3, and L4 include the pairs of substantially parallel signal wiring lines L1*a* and L1*b*, L2*a* and L2*b*, L3*a* and L3*b*, and L4*a* and L4*b*, respectively. The signal wiring lines of each differential transmission line are arranged in the vertical direction (reference direction). The signal wiring line L2*a* of the differential transmission line L2 opposes the signal wiring line L1*a* of the differential transmission line L1, which is adjacent to the signal wiring line L2*a*, obliquely with respect to the vertical direction. The signal wiring line L2*a* of the differential transmission line L2 and the signal wiring line L1*b* of the differential transmission line L1 are located in the same M4 layer. The signal wiring line L4*a* of the differential transmission line L4 opposes the signal wiring line L3*a* of the differential transmission line L3, which is adjacent to the signal wiring line L4*a*, obliquely with respect to the vertical direction. The signal wiring line L4*a* of the differential transmission line L4 and the signal wiring line L3*b* of the differential transmission line L3 are located in the same M3 layer. An ILD (interlayer dielectric film) is formed between the wiring lines of each differential transmission line and between the differential transmission lines. The signal wiring lines L1*a*, L1*b*, L2*a*, L2*b*, L3*a*, L3*b*, L4*a*, and L4*b* are made of a metal such as aluminum. The ILD is made of $SiO_2$ or the like.

Figure 27:
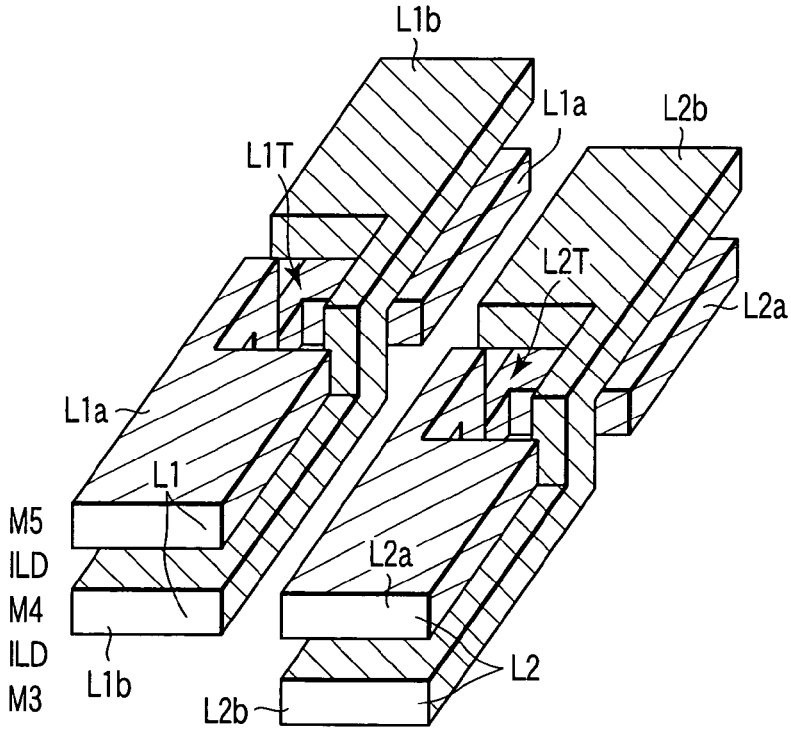
FIG. 27 is a partial perspective view of the parallel wiring structure shown in FIG. 26.

FIG. 27 is a partial perspective view showing the parallel wiring structure shown in FIG. 26. Referring to FIG. 27, the signal wiring lines L1*a* and L1*b* of the differential transmission line L1 and the signal wiring lines L2*a* and L2*b* of the differential transmission line L2 cross and replace their positions at the twisted portions L1T and L2T, respectively, without coming into contact with each other (the signal wiring line L1*a* runs from the M5 layer to the M4 layer, the signal wiring line L1*b* runs from the M4 layer to the M5 layer, the signal wiring line L2*a* runs from the M4 layer to the M3 layer, and the signal wiring line L2*b* runs from the M3 layer to the M4 layer). Hence, the signal wiring lines L1*a*, L1*b*, L2*a*, and L2*b* do not come into contact with the neighboring signal wiring lines. More specifically, in the differential transmission line L1, the signal wiring line L1*a* decreases its width in the M5 layer and runs in this state downward from the M5 layer to the M4 layer via the ILD layer. The signal wiring line L1*a* runs in the virtual extending direction of the signal wiring line L1*b* in the M4 layer. The width returns to the original width. The signal wiring line L1*b* decreases its width in the M4 layer and runs in this state upward from the M4 layer to the M5 layer via the ILD layer. The signal wiring line L1*b* runs in the virtual extending direction of the signal wiring line L1*a* in the M5 layer. The width returns to the original width. This also applied to the differential transmission line L2.

In the structure shown in FIG. 27, the vertical distance (thickness) of the entire parallel wiring can be shortened as compared to FIG. 25. In addition, the common mode component can be reduced by the twisted diagonal-pair line structure above the Si substrate. Hence, EMI noise can be suppressed. In addition, since the twisted diagonal-pair line structure is applied, crosstalk of the differential mode and common mode can be reduced as a secondary effect.

As described above, according to the fifth embodiment, EMI noise can be reduced by using the twisted diagonal-pair line for the long-distance wiring line in an Si-LSI. In addition, a parallel wiring and an integrated circuit, which have a high wiring density and low crosstalk between differential wiring lines, can be provided.

The present invention is not limited to the above-described embodiments, and various changes and modifications can be made without departing from the spirit and scope of the invention. For example, in each of the above embodiments, a parallel wiring using differential transmission lines has been described. However, the present invention is not limited to this. The present invention can be applied to any parallel wiring line by a differential scheme. The present invention can be applied not only to an LSI but also to various kinds of integrated circuits and boards.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general invention concept as defined by the appended claims and their equivalents.

What is claimed is:

1. A parallel wiring comprising:

at least one first differential line including two wiring lines which are substantially parallel to each other in a reference direction; and at least one second differential line including two wiring lines which are substantially parallel to each other in the reference direction, wherein the two wiring lines of the at least one first differential line and the two wiring lines of the at least one second differential line are not twisted, wherein one wiring line of the at least one first differential line and one wiring line of the at least one second differential line adjacent to said one wiring line of the at least one first differential line oppose each other obliquely with respect to the reference direction, the one wiring line of the at least one first differential line and another wiring line of the at least one first differential line being provided obliquely with respect to the reference direction, and wherein the one wiring line and the another wiring line of said at least one first differential line are arranged at positions where a coupling coefficient between the at least one first differential line and said at least one second differential line adjacent to the at least one first differential line is smaller than a specified value determined by a noise margin.

2. The wiring according to claim 1, wherein the reference direction is a horizontal direction.

3. The wiring according to claim 1, wherein the reference direction is a vertical direction.

4. The wiring according to claim 1, wherein an interlayer dielectric film is formed between the two wiring lines of each differential line.

5. An integrated circuit comprising a parallel wiring of claim 1.

6. The wiring according to claim 1, wherein the specified value is 0.1.

7. The wiring according to claim 1, wherein a distance between said one wiring line of said at least one first differential line and said one wiring line of said at least one second differential line is substantially equal to a distance between said another wiring line of said at least one first differential line and said another wiring line of said at least one second differential line.

8. A parallel wiring without twisting comprising:

at least one first differential line including two wiring lines which are substantially parallel to each other in a reference direction; and at least one second differential line including two wiring lines which are substantially parallel to each other in the reference direction, wherein one wiring line of the at least one first differential line and one wiring line of the at least one second differential line oppose each other and are juxtaposed in a reference direction, the one wiring line of the at least one first differential line and another wiring line of the at least one first differential line being provided obliquely with respect to the reference direction, and wherein the one wiring line and the another wiring line of said at least one first differential line are arranged at positions where a coupling coefficient between the at least one first differential line and said at least one second differential line adjacent to the at least one first differential line is smaller than a specified value determined by a noise margin.

9. A parallel wiring without twisting comprising:

at least one first differential line including two wiring lines which are substantially parallel to each other and are juxtaposed in a reference direction; and at least one second differential line including two wiring lines which are substantially parallel to each other and are juxtaposed in the reference direction, wherein one wiring line of the at least one first differential line and another wiring line of the at least one first differential line oppose each other, the one wiring line of the at least one first differential line and one wiring line of the at least one second differential line being provided obliquely with respect to the reference direction, the another wiring line of the at least one first differential line and another wiring line of the at least one second differential line being provided obliquely with respect to the reference direction, and wherein the one wiring line and the another wiring line of said at least one first differential line are arranged at positions where a coupling coefficient between the at least one first differential line and said at least one second differential line adjacent to the at least one first differential line is smaller than a specified value determined by a noise margin.

10. A parallel wiring without twisting comprising:

at least one first differential line including two wiring lines which are substantially parallel to each other and are juxtaposed in a reference direction; and at least one second differential line including two wiring lines which are substantially parallel to each other and are juxtaposed in the reference direction, wherein one wiring line of the at least one first differential line and another wiring line of the at least one first differential line oppose each other, the one wiring line of the at least one first differential line and the one wiring line of the at least one second differential line being provided obliquely with respect to the reference direction, the another wiring line of the at least one first differential line and another wiring line of the at least one second differential line being provided obliquely with respect to the reference direction, the one wiring line of the at least one second differential line being arranged between the one wiring line and the another wiring line of the at least one first differential line, the another wiring line of the at least one first differential line being arranged between the one wiring line and the another wiring line of the at least one second differential line, and wherein the one wiring line and the another wiring line of said at least one first differential line are arranged at positions where a coupling coefficient between the at least one first differential line and said at least one second differential line adjacent to the at least one first differential line is smaller than a specified value determined by a noise margin.

11. The wiring according to claim 10, wherein one wiring line of said at least one first differential line and one wiring line of said at least one second differential line adjacent to said at least one first differential line are located in the same layer.

12. The wiring according to claim 10, wherein said one wiring line of said at least one second differential line is substantially equidistant from said one wiring line and said another wiring line of said at least one first differential line.

* * * * *